US006633138B2

(12) United States Patent
Shannon et al.

(10) Patent No.: US 6,633,138 B2
(45) **Date of Patent: *Oct. 14, 2003**

(54) METHOD AND APPARATUS FOR CONTROLLING A DISCHARGE LAMP IN A BACKLIGHTED DISPLAY

(75) Inventors: John Robert Shannon, Daly City, CA (US); James Copland Moyer, San Jose, CA (US); Michael Ren Hsing, Saratoga, CA (US)

(73) Assignee: Monolithic Power Systems, Inc., Los Gatos, CA (US)

( * ) Notice: Subject to any disclaimer, the term of this patent is extended or adjusted under 35 U.S.C. 154(b) by 174 days.

This patent is subject to a terminal disclaimer.

(21) Appl. No.: 09/885,244

(22) Filed: Jun. 19, 2001

(65) Prior Publication Data

US 2002/0047601 A1 Apr. 25, 2002

Related U.S. Application Data

(62) Division of application No. 09/528,407, filed on Mar. 17, 2000, now Pat. No. 6,316,881, which is a division of application No. 09/209,586, filed on Dec. 11, 1998, now Pat. No. 6,114,814.

(51) Int. Cl.[7] ..... H05B 37/02

(52) U.S. Cl. ..... 315/224; 315/276

(58) Field of Search ..... 315/224, 225, 315/291, 307, 308, 209 R, 219, 276, 244, DIG. 7

(56) References Cited

U.S. PATENT DOCUMENTS

| | | | |
|---|---|---|---|
| 4,541,041 A | 9/1985 | Park et al. | 363/41 |
| 4,672,528 A | 6/1987 | Park et al. | 363/98 |
| 4,727,469 A | 2/1988 | Kammiller | 363/56 |

(List continued on next page.)

OTHER PUBLICATIONS

Coaton, Lamps and Lighting, 1997, Arnold, 4th edition, pp. 105 and 107.*

Parker, Dictionary of Scientific and Technical Terms, 1994, McGraw–Hill, 5th edition, p. 1294.*

02 Micro International Limited's and 02 Micro, Inc.'s Preliminary Invalidity Contentions; Case Nos.: CV–00–4071 (CW)(EDL) and CV–01–3995 (CW); 13 pages.

Plaintiff 02 Micro International Limited's and Counterdefendant 02 Micro Inc.'s Final Invalidity Contentions, Case No. CV–00–4071 CW, 7 pages.

Basch et al. 620 Claim Chart, U.S. patent No. 5,270,620 (Claims 1,2,6–9, 14, 21, and 25); 8 pages.

Basch et al. 620 Claim Chart, U.S. patent No. 5,270,620 (Claim 18); 6 pages.

(List continued on next page.)

*Primary Examiner*—Don Wong
*Assistant Examiner*—Wilson Lee
(74) *Attorney, Agent, or Firm*—Perkins Coie LLP

(57) ABSTRACT

The described DC to AC inverter efficiently controls the amount of electrical power used to drive a cold cathode fluorescent lamp (CCFL). The output is a fairly pure sine wave which is proportional to an input control voltage. The output waveform purity is ensured by driving a symmetrical rectangular waveform into a second-order, low pass filter at the resonant frequency of the filter for all conditions of line voltage and delivered power. Operating stress on the step-up transformer is minimized by placing the load (lamp) directly across the secondary side of the transformer. When configured to regulate delivered power, the secondary side may be fully floated which practically eliminates a thermometer effect on the operation of the lamp. All of the active elements, including the power switches, may be integrated into a monolithic silicon circuit.

30 Claims, 17 Drawing Sheets

U.S. PATENT DOCUMENTS

| | | | | |
|---|---|---|---|---|
| 4,794,506 | A | 12/1988 | Hino et al. | 363/25 |
| 4,855,888 | A | 8/1989 | Henze et al. | 363/17 |
| 4,935,857 | A | 6/1990 | Nguyen et al. | 363/17 |
| 4,952,849 | A | 8/1990 | Fellows et al. | 315/307 |
| 4,988,920 | A | 1/1991 | Hoeksma | 315/101 |
| 4,992,919 | A | 2/1991 | Lee et al. | 363/17 |
| 5,105,127 | A | 4/1992 | Lavaud et al. | 315/291 |
| 5,157,592 | A | 10/1992 | Walters | 363/17 |
| 5,166,579 | A | * 11/1992 | Kawabata et al. | 315/209 R |
| 5,270,620 | A | 12/1993 | Basch et al. | 315/291 |
| 5,285,372 | A | 2/1994 | Huynh et al. | 363/132 |
| 5,311,104 | A | 5/1994 | Antle | 315/307 |
| 5,315,498 | A | 5/1994 | Berrios et al. | 363/98 |
| 5,363,020 | A | 11/1994 | Chen et al. | 315/209 R |
| 5,384,516 | A | 1/1995 | Kawabata et al. | 315/160 |
| 5,402,043 | A | 3/1995 | Nilssen | 315/307 |
| 5,422,546 | A | 6/1995 | Nilssen | 315/219 |
| 5,438,242 | A | 8/1995 | Simpson | 315/219 |
| 5,481,160 | A | 1/1996 | Nilssen | 315/209 R |
| 5,550,436 | A | 8/1996 | Honk | 315/209 R |
| 5,583,402 | A | 12/1996 | Moisin et al. | 315/307 |
| 5,604,411 | A | 2/1997 | Venkitasubrahmanian et al. | 315/307 |
| 5,615,093 | A | 3/1997 | Nalbant | 363/25 |
| 5,619,402 | A | 4/1997 | Liu | 363/20 |
| 5,642,065 | A | 6/1997 | Choi et al. | 327/110 |
| 5,677,602 | A | 10/1997 | Paul et al. | 315/224 |
| 5,694,007 | A | 12/1997 | Chen | 315/247 |
| 5,712,533 | A | 1/1998 | Corti | 315/169.3 |
| 5,719,474 | A | 2/1998 | Vitello | 315/307 |
| 5,744,915 | A | 4/1998 | Nilssen | 315/209 R |
| 5,754,012 | A | 5/1998 | LoCascio et al. | 315/307 |
| 5,781,418 | A | 7/1998 | Chang et al. | 363/16 |
| 5,844,540 | A | 12/1998 | Terasaki | |
| 5,875,103 | A | 2/1999 | Bhagwat et al. | 363/17 |
| 5,910,709 | A | 6/1999 | Stevanovic et al. | 315/225 |
| 5,923,129 | A | 7/1999 | Henry | 315/307 |
| 5,930,121 | A | 7/1999 | Henry | 363/16 |
| 5,932,976 | A | 8/1999 | Maheshwari et al. | 315/291 |
| 5,939,830 | A | 8/1999 | Praiswater | |
| 6,002,210 | A | 12/1999 | Nilssen | 315/219 |
| 6,011,360 | A | 1/2000 | Gradzki et al. | 315/244 |
| 6,016,052 | A | 1/2000 | Vaughn | 323/155 |
| 6,114,814 | A | * 9/2000 | Shannon et al. | 315/219 |
| 6,316,881 | B1 | * 11/2001 | Shannon et al. | 315/219 |

OTHER PUBLICATIONS

Basch et al./Berrios et al. Claim Chart, U.S. patent No. 5,270,620/5,315,498 (Claim 22); 7 pages.

Basch et al./Berrios et al. Claim Chart, U.S. patent No. 5,270,620/5,315,498 (Claim 23); 7 pages.

Chen 007 Claim Chart, U.S. patent No. 5,694,007 (Claims 1, 8, 9, 14, 21, and 25); 9 pages.

Henry 129 Patent Claim Chart, U.S. patent No. 5,923,129 (Claim 3); 4 pages.

Hoeksma 920 Patent Claim Chart, U.S. patent No. 4,988,920 (Claim 10); 4 pages.

Hoeksma 920/Vaughn 052 Patent Claim Chart, U.S. patent No. 4,988,920 (Claim 10); 3 pages.

Kawabata et al. 579 Claim Chart, U.S. patent No. 5,166,579 (Claim 1, 2, 6–9, 14, and 21); 8 pages.

Kawabata et al. 579 Claim Chart, U.S. patent No. 5,166,579 (Claim 18); 6 pages.

Kawabata et al./Hoeksma Claim Chart, U.S. patent Nos. 5,166,579/4,988,920 (Claim 8); 7 pages.

Nilssen 043 Claim Chart, U.S. patent No. 5,402,043 (Claim 1, 8, 9, 14, 15, 21, 25, and 26); 10 pages.

Nilssen 210/Hoeksma 920 Patent Claim Chart, U.S. patent Nos. 6,002,210/4,988,920 (Claim 10); 7 pages.

Nilssen/Berrios et al. Claim Chart, U.S. patent Nos. 5,402,043/5,315,498 (Claim 22); 7 pages.

Nilssen/Berrios et al. Claim Chart, U.S. patent Nos. 5,402,043/5,315,498 (Claim 23); 7 pages.

Park/Vaugh Claim Chart, U.S. patent No. 4,541,041 (Claim 3); 5 pages.

Paul et al. 602 Claim Chart, U.S. patent No. 5,677,602 (1, 2, 6–9, 14 and 21); 9 pages.

Paul et al. 602 Claim Chart, U.S. patent No. 5,677,602 (Claim 18); 5 pages.

Paul et al./Hoeksma Claim Chart, U.S. patent Nos. 5,677,602/4,988,920 (Claim 8); 7 pages.

Praiswater 830/Park 041 Patent Claim Chart, U.S. patent No. 5,939,830 (Claim 3); 8 pages.

Vaughn 052 Patent Claim Chart, U.S. patent No. 6,016,052 (Claim 3); 6 pages.

Vaughn 052 Patent Claim Chart, U.S. patent No. 6,016,052 (Claim 10); 6 pages.

Andreycak, Bill; Phase Shifted, Zero Voltage Transition Design Considerations and the UC3875 PWM Controller; May 1997, Unitrode Corporation.

Balogh, Laszio; The New UC3879 Phase–Shifted PWM Controller Simplified the Design of Zero Voltage Transition Full–Bridge Converters; Unitrode Corporation.

Chen, W. et al; A Comparative Study of a Class of Full Bridge Zero–Voltage Switched PWM Converters; Virginia Polytechnic Institutes and State University; Blacksburg, Virginia.

Coaton, J.R. and A.M. Marsden, Lamps and Lighting, Joh Wiley & Sons, Inc. pp. 322–324.

Farrington, Richard et al; High Density Power–Hybrid Design of a Half–Bridge Multi–Resonant Converter; Virginia Polytechnic Institute and State University; Blacksburg, Virginia.

Fisher, R.A. et al; A Frequency/PWM Controlled Converter With Two Independently Regulated Outputs; GE Corporate Research and Development Center; Schenectady, NY.

Nalbant, Mehmet K; A New and Improved Control Technique Greatly Simplifies the Design of ZVS Resonant Inverts and DC/DC Power Supplies; Linfinity Microelectronics; Garden Grove, California.

Pressman, Abraham I.; Switching Power Supply Design; McGraw–Hill 1991.

Redl, Richard et al.; Optimum ZVS DC/DC Converter with PWM Phase–Shift Control; Analysis, Design Considerations, and Experimental Results (Switzerland/Washington USA).

Sum, K. Kit (editor); Recent Developments in Resonant Power Conversion; Intertec Communications Press; Summit Electronics, Inc., Highland, Illinois.

Takano, H. et al; Feasible Characterisitic Evaluations of Resonant Tank PWM Inverter–Linked DC–DC High–Power Converters for Medical–Use–High–Voltage Application; Japan.

Unitrode Corporation; Power Supply Design Seminar 1991.

Vlatkovic, V. et al; Small–Signal Analysis of the Zero–Voltage Switched Full Bridge PWM Converter; Virginia Polytechnic Institute and State University; Blacksburg, Virginia.

* cited by examiner

"ROYER" OR CURRENT FED PUSH PULL

FIXED OUTPUT NON DIMMING

200

$V_{SUPPLY}$
$-V_{SUPPLY}$
212
222
218
220
214
210
216
TIME $I_{PEAK}$
$-I_{PEAK}$
235
226
234
224
228
230
232
TIME $V_{SUPPLY}$
$-V_{SUPPLY}$
236
244
238
240
242
TIME $I_{PEAK}$
$-I_{PEAK}$
256
252
258
250
254
246
248
TIME

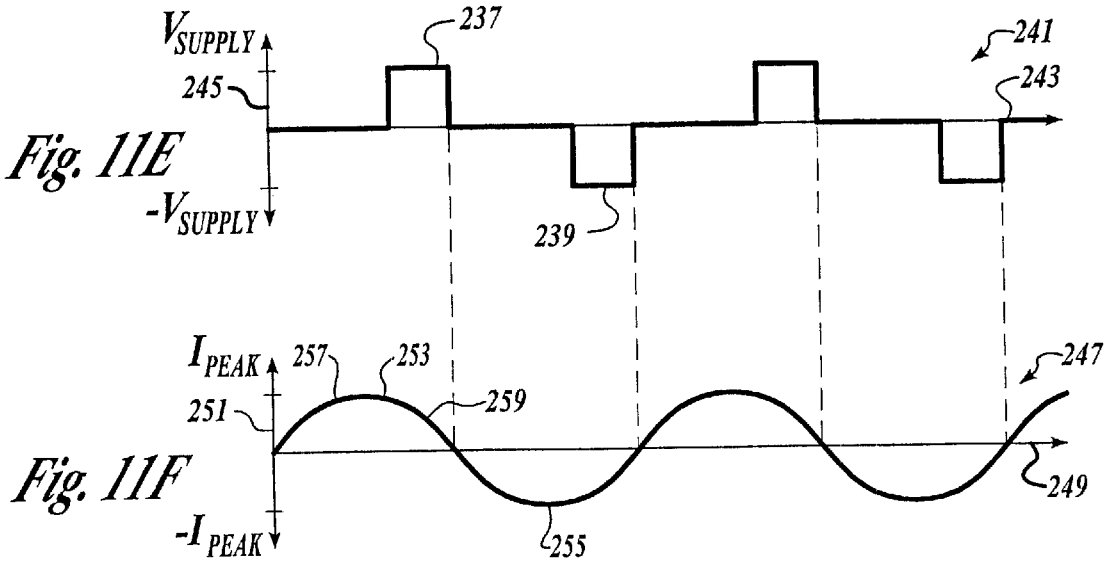
Fig. 11E
Fig. 11F
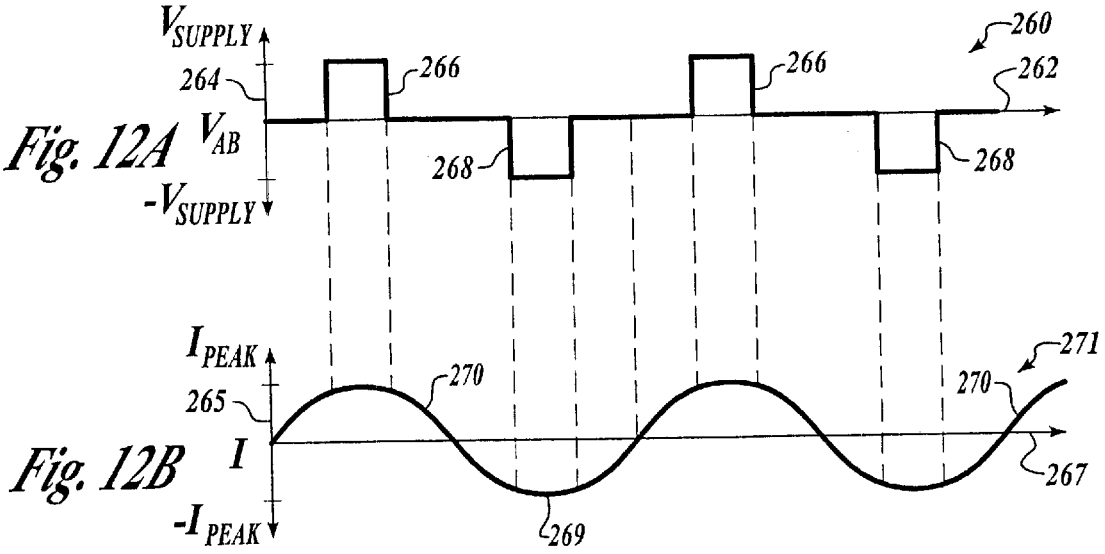
Fig. 12A
Fig. 12B $V_{SUPPLY}$
$V_A$
274
276
276
276
278
272

$V_{SUPPLY}$
$V_B$
280
282
282
282
286
284

$V_{SUPPLY}$
$V_{AB}$
240
$-V_{SUPPLY}$
292
292
292
288
296
294
294
294

$I_{PEAK}$
306
I
$-I_{PEAK}$
304
303
300
302

$V_{SUPPLY}$
$V_A$
314
312
308
310

$V_{SUPPLY}$
$V_B$
316
322
318
320

$V_{SUPPLY}$
$V_{AB}$
330
324
332
333
334
I
II
III
IV
294
326
328

$I_{PEAK}$
346
I
$-I_{PEAK}$
342
343
336
338

344

$V_{COMP}$
362
356
360
358

$V_{BURST}$
368
369
364
366

$V_B$
374
371
370
372

$V_A$
380
377
376
378

$I_{LAMP}$
386
383
382
384

$I_{SENSE}$
396
396
397
394
392

$I_{LAMP}$
404
406
412
402
400

$I_{LAMP}$
412
414
410
408
180Hz
15I 412
50Hz

METHOD AND APPARATUS FOR CONTROLLING A DISCHARGE LAMP IN A BACKLIGHTED DISPLAY

The present patent application is a Divisional of prior application no. 09/528,407, filed Mar. 17, 2000, entitled METHOD AND APPARATUS FOR CONTROLLING A DISCHARGE LAMP IN A BACKLIGHTED DISPLAY is now a U.S. Pat. No. 6,316,881 which is a divisional of prior application Ser. No. 09/209,586 is now a U.S. Pat. No. 6,114,814 filed Dec. 11, 1998.

FIELD OF THE INVENTION

The present invention relates to the field of discharge lighting and, in particular, to efficiently supplying electrical power for driving a discharge lamp, such as used to backlight a color liquid crystal display (LCD) panel, by controlling an alternating current signal that is generated from a range of direct current signals.

BACKGROUND OF THE INVENTION

A discharge lamp used to backlight an LCD panel such as a cold cathode fluorescent lamp (CCFL) has terminal voltage characteristics that vary depending upon the immediate history and the frequency of a stimulus (AC signal) applied to the lamp. Until the CCFL is "struck" or ignited, the lamp will not conduct a current with an applied terminal voltage that is less than the strike voltage, e.g., the terminal voltage must be equal to or greater than 1500 Volts. Once an electrical arc is struck inside the CCFL, the terminal voltage may fall to a run voltage that is approximately ⅓ the value of the strike voltage over a relatively wide range of input currents. For example, the run voltage could be 500 Volts over a range of 500 microAmps to 6 milliAmps for a CCFL that has a strike voltage of 1,500 Volt. When the CCFL is driven by an AC signal at a relatively low frequency, the CCFL's electrical arc tends to extinguish and ignite on every cycle, which causes the lamp to exhibit a negative resistance terminal characteristic. However, when the CCFL is driven by another AC signal at a relatively high frequency, the CCFL (once struck) will not extinguish on each cycle and will exhibit a positive resistance terminal characteristic. Since the CCFL efficiency improves at the relatively higher frequencies, the CCFL is usually driven by AC signals having frequencies that range from 50 KiloHertz to 100 KiloHertz.

Also, the mean time between failure for a CCFL is dependent upon several aspects of the operating environment. For example, driving the CCFL at a power level that is higher than the rated power level tends to shorten the useful lifetime of the lamp. Also, driving the CCFL with an AC signal that has a high crest factor can cause premature failure of the lamp. The crest factor is the ratio of the peak current to the average current that flows through the CCFL. Additionally, it is known that driving a CCFL with a relatively high frequency square-shaped AC signal will produce the maximum useful lifetime for the lamp. However, since the square shape of an AC signal may cause significant interference with another circuit disposed in the immediate vicinity of the circuitry driving the CCFL, the lamp is typically driven with an AC signal that has a less than optimal shape such as a sine-shaped AC signal.

Most small CCFLs are used in battery powered systems, e.g., notebook computers and personal digital assistants. The system battery supplies a direct current (DC) voltage ranging from 7 to 20 Volts with a nominal value of about 12V to an input of a DC to AC inverter. A common technique for converting a relatively low DC input voltage to a higher AC output voltage is to chop up the DC input signal with power switches, filter out the harmonic signals produced by the chopping, and output a relatively clean sine-shaped AC signal. The voltage of the AC signal is stepped up with a transformer to a relatively high voltage, e.g., from 12 to 1500 Volts. The power switches may be bipolar junction transistors (BJT) or Field Effect Transistors (FET or MOSFET). Also, the transistors may be discrete or integrated into the same package as the control circuitry for the DC to AC converter.

Since resistive components tend to dissipate power and reduce the overall efficiency of a circuit, a typical harmonic filter for a DC to AC converter employs inductive and capacitive components that are selected to minimize power loss, i.e., each of the selected components should have a high Q value. The Q value identifies the "quality factor" of an inductor or a capacitor by indicating the ratio of energy stored to energy lost in the component for a complete cycle of an AC signal at a rated operational frequency. The Q value of a component will vary with the frequency and amplitude of a signal, so a filter must be designed for minimum (or acceptable) loss at the operating frequency and required power level. Also, some DC to AC converter filters incorporate the inductance of the step-up transformer, either in the magnetizing inductance of the primary or in the leakage inductance of the secondary.

A second-order resonant filter formed with inductive and capacitive components is also referred to as a "tank" circuit because the tank stores energy at a particular frequency. The unloaded Q value of the tank may be determined by measuring the parasitic losses of the tank components, i.e., the total energy stored by the tank for each cycle of the AC signal is divided by the total energy lost in the tank components each cycle. A high efficiency tank circuit will have a high unloaded Q value, i.e., the tank will employ relatively low loss capacitors and inductors.

The loaded Q value of a tank circuit may be measured when power is transferred through the tank from an energy source to a load, i.e., the ratio of the total energy stored by the tank in each cycle of the AC signal divided by the total energy lost in the tank plus the energy transferred to the load in each cycle. The efficacy of the tank circuit as a filter depends on its loaded Q value, i.e., the higher the loaded Q value, the purer the shape of the sine wave output. Also, the efficiency of the tank circuit as a power transmitter depends on the ratio of the unloaded Q to the loaded Q. A high efficiency tank circuit will have an unloaded Q set as high as practical with a loaded Q set as low as possible. Additionally, the loaded Q of the tank circuit may be set even smaller to increase the efficiency of the filter, if the signal inputted to the tank has most of its energy in a fundamental frequency and only a small amount of energy is present in the lower harmonic frequencies.

The energy of a periodic waveform may be assigned to discrete frequencies, i.e., the fundamental repetition frequency and integer multiples of the fundamental repetition frequency. The fundamental repetition frequency is referred to as the fundamental and the integer multiples are termed harmonics. Generally, waveforms with sharp edges have fast rise and fall times and they have more energy in high order harmonics than waveforms with smooth edges and relatively slow transitions. However, generating waveforms with smooth, slow transitions usually causes fairly high power dissipation in the chopping switches, so the actual waveform is usually a compromise between efficient (sharp), fast edges and quiet (smooth), slow edges. Waveforms that are symmetric, i.e., the up-going waveform shape is the mirror image of the down-going shape but shifted in time, tends to suppress or cancel the even harmonics, which are the fundamental frequency times the integer values of 2, 4, 6, 8, 10, etc. The suppression or cancellation of the even harmonics is important because the harmonic frequency closest to the fundamental frequency is the second harmonic, which is the most difficult harmonic frequency to filter out of the waveform.

The largest component in a small DC to AC inverter circuit for a CCFL is the step-up transformer. Typically, this transformer includes a primary and a secondary winding coiled around a plastic bobbin mounted to a ferrite core. This type of transformer has two characteristic inductances associated with each winding, i.e., a magnetizing inductance and a leakage inductance. The value of the magnetizing inductance for each winding is measured when the other winding is configured as an open circuit, i.e., a no load state. Also, the value of the leakage inductance for each winding is measured when the other winding is configured as a short circuit.

The magnetizing inductance of a winding is a measure of how well the particular winding is coupled to the core of the transformer, i.e., a large magnetizing inductance is an indication that the magnetic flux of the winding is mostly contained within the core. A gap in the core will lower the magnetizing inductance because all of the magnetic flux is forced to leave the core at the gap. Thus, a relatively small transformer may be used to deliver a given power level, if the core is not gapped.

The leakage inductance is a measure of how poorly a winding is coupled to the other winding, i.e., a large leakage inductance indicates when the other winding is shorted. Since a high voltage, e.g., a strike voltage of 1500 volts, may be impressed on the secondary winding of the transformer for a CCFL converter, relatively thick insulators are typically used between the primary and the secondary windings. However, thick insulators tend to cause the leakage inductances of the primary and secondary windings to be relatively large.

The intensity of light emitted by a CCFL may be dimmed by driving the lamp with a lower power level (current). Dimming the light emitted by the CCFL enables the user to accommodate a wide range of ambient light conditions. Because the CCFL impedance will increase as the power level driving the lamp is reduced, i.e., an approximately constant voltage with a decreasing current, currents in the stray capacitances between neighboring conductors (e.g., ground shields, wiring) and the lamp tend to become significant. For example, if the control circuitry requires that one terminal of the CCFL is tied to signal ground for measuring current through the lamp, the current in the grounded terminal of the lamp will be significantly less than the current flowing into the other terminal of the lamp. In this case, a thermometer effect on the CCFL will be produced, whereby the grounded end of the lamp has almost no current flowing in it and the arc essentially extinguishes while the other end of the lamp is still arcing and emitting light. The thermometer effect may be greatly reduced by the technique of driving the CCFL, so that the signal at one end of the lamp is equal to and exactly out of phase with the signal at the other end. This technique is typically termed a balanced drive and it may be approximated by driving the CCFL with a floating secondary winding, i.e., neither end of the secondary winding is tied to ground.

SUMMARY OF THE INVENTION

The invention is a method and apparatus for efficiently converting a direct current (DC) signal into an alternating current (AC) signal for driving a load such as a discharge lamp. A network of a plurality of switches converts a DC signal coupled to the network into an AC signal. A tank circuit is coupled between the network of the plurality of switches and the discharge lamp. The tank circuit filters and smoothes the AC signal that is transmitted from the network of the plurality of switches to the discharge lamp. A controller employs a resonant frequency of the tank circuit to control the oscillation of the network of the plurality of switches between the open and closed positions. Since the network of the plurality of switches oscillates at the resonant frequency of the tank circuit, the AC signal drives the discharge lamp with the optimal amount of electrical power over a range of AC signal voltages. Additionally, the network of the plurality of switches and the controller may be disposed in a monolithic integrated circuit.

The tank circuit includes a step-up transformer with a primary winding that receives the AC signal from the network of the plurality of switches and a secondary winding that is coupled to the discharge lamp. The ratio of the primary winding and the secondary winding causes an AC signal with a relatively higher voltage to be induced across the secondary winding than the AC signal transmitted to the primary winding. The tank circuit includes a filter for the AC signal. The filter may be disposed between the network of the plurality of switches and the primary winding of the step-up transformer. Alternatively, the filter may be positioned between a secondary winding of the step-up transformer and the load.

The filter may be a second order filter that includes an inductor and a capacitor. The filter provides for suppressing a harmonic signal associated with the AC signal and smoothing the AC signal's waveform.

The plurality of switches may be MOSFETs that are arranged in an H-bridge network.

A zero crossing detector determines the resonant frequency of the tank circuit by indicating to the controller the zero crossing point of the current in the tank circuit. This indication is used by the controller to follow the frequency response of the tank circuit by providing an indication of the zero crossing point of the tank circuit's resonant frequency in real time. This indication is used by the controller to follow the frequency response of the tank circuit when the amount of loading presented by the discharge lamp has caused the circuit's resonant frequency to shift away from an initial, i.e., unloaded, resonant frequency.

The load may be a discharge lamp, including a cold cathode fluorescent, metal halide and sodium vapor.

A brightness control may be provided for enabling a user to dim the amount of light emitted by the discharge lamp. Also, a loop compensation capacitor may have an end connected to a voltage reference and another end coupled to an on-time timer, the brightness control and the controller. The voltage impressed across the loop compensation capacitor is used by the timer to set the "on" time for each power phase of the plurality of switches. Also, the loop compensation capacitor's voltage is set by a feedback loop that compares a DC voltage modulated by the brightness control with either the amount of current or power delivered to the discharge lamp.

The controller uses the voltage impressed across the loop compensation capacitor to determine the time interval of the on-time timer for each power phase. Also, the controller employs the zero crossing detector to determine when to switch to the next phase of the cycle and begin injecting an amount of energy into the tank circuit. In the event of a conflict between the time interval of the on-time timer and the indication provided by the zero crossing detector, i.e., the detector provides the indication before the time interval is over, the detector wins and controller will cause the H-bridge components to switch to the next phase of the cycle.

The controller implements several logical determinations that, if true, will cause the controller to stop the AC signal from driving the load, including: (1) determining if an undervoltage condition is occurring at the battery supply; (2) determining when a thermal overload condition is occurring; and (3) determining if the load current has exceeded a predetermined maximum value. The controller may also determine if an on mode is selected, and if so enable the AC signal to drive the load.

Additionally, the controller may respond to a burst mode signal from the user, and if so the controller switches the H-bridge MOSFETs "on" and "off" at a user-determined burst mode frequency that is substantially lower than the AC signal driving the load, e.g., the AC signal driving the discharge lamp may have a 50 KiloHertz frequency and the burst mode switching (on and off periods) may occur at a 180 Hertz frequency. The loop compensation capacitor is neither charged nor discharged during the burst mode off period so that the on-time period of the timer is "remembered" for use in the next on period.

Since the burst mode reduces the total amount of energy that the discharge lamp is receiving, the amount of light emitted by the lamp is dimmed. Also, burst mode switching enables the discharge lamp to be dimmed without having to compensate for stray capacitances between the leads of the discharge lamp. Analog dimming may be used in combination with burst mode switching to provide an even larger range of dimming for the discharge lamp.

A gate driver may be provided for each MOSFET in the H-bridge network. The gate driver amplifies logic signals that control the operation of the associated MOSFET. Also, the gate driver may provide a lockout mode of operation that prevents the associated MOSFET from cross conducting with another MOSFET. The gate drivers are used to limit current in case of an open lamp condition and a terminal short to ground.

A capacitor may be provided with an end connected to a voltage reference and another end coupled to an output terminal of the H-bridge network and the load. The capacitor provides energy for an upper MOSFET's gate driver when a turn on voltage is applied to a gate of the upper MOSFET. In this case, the voltage at a source of the upper MOSFET is approximately equal to the input supply voltage when the MOSFET is on. Additionally, the gate driver may provide for initially charging the capacitor before the load is driven by the AC signal. Further, the gate driver may recharge the capacitor when the MOSFET associated with gate driver is not conducting.

The oscillation of the plurality of switches based on a resonant frequency of the tank circuit is performed in a predetermined cycle. In a first power phase of the cycle, a portion of the plurality of switches is turned on to supply a portion of the AC signal. In a second power phase of the cycle, another portion of the plurality of switches is turned on to generate an opposite portion of the AC signal. The plurality of switches oscillate between the first and second power phases. Additionally, the cycle may cause the plurality of switches to exit the first power phase and enter a first rest phase, and exit the second power phase and enter a second rest phase. The AC power delivered to the load may be varied by changing the ratio of the time spent in the power phases versus the time spent in the rest phases of the cycle.

The gate driver may determine if the flow of current through the associated MOSFET is equal to or greater than a predetermined value. If true, the associated MOSFET will be turned off for the current power phase, either the first power phase or the second power phase, until the start of the next power phase.

The method provides for substantially the same functionality of the apparatus, albeit in ways that may differ.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIGS. 11A, 11C and 11E display four graphs for the corresponding voltage and current waveforms that are generated when driving the discharge lamp at both maximum and partial duty cycle;

FIGS. 11B, 11D and 11F illustrate two graphs for leading edge modulation of the voltage waveform and the corresponding current waveform at partial power;

FIG. 12 shows two graphs for double sided modulation of the voltage waveform and the corresponding current waveform at partial power;

FIGS. 13A, 13B, 13C, 13E, 13F and 13G illustrate four graphs for pulse train phase modulation of the voltage waveform and the current waveform at fall power;

FIGS. 13D–13H displays four graphs for pulse train phase modulation of the voltage waveform and the current waveform at partial power;

DETAILED DESCRIPTION OF THE INVENTION

The invention provides efficient control of power switches (MOSFET transistors) supplying electrical power to a discharge lamp such as a cold cathode fluorescent lamp (CCFL) by integrating the switches and control circuitry into a single integrated circuit package. The control circuitry precisely measures the voltages across and currents through the power switches so that the electrical power supplied by the power switches to the CCFL may be accurately measured. This aspect of the invention avoids the cost and complexity of a separate current sensing element such as a current transformer and permits a fully-floating transformer secondary winding that significantly reduces the thermometer effect in the operation of the CCFL. Also, since the actual electrical power instead of the current at one end of the lamp is regulated, the invention is relatively immune to the effects of parasitic capacitive loading at its output and allows for greater ease of application with a variety of backpanels. Moreover, since the invention operates at the resonant frequency of the load under all conditions (normal and dimming), the power transistors have zero voltage switching and improved operational efficiency.

In another embodiment of the invention, one end of the step-up transformer's secondary winding and one end of the lamp may be coupled to ground so that the current flowing through one end of the lamp to ground may be measured for controlling the amount of electrical power driving the lamp.

Prior Art

Figure 1:
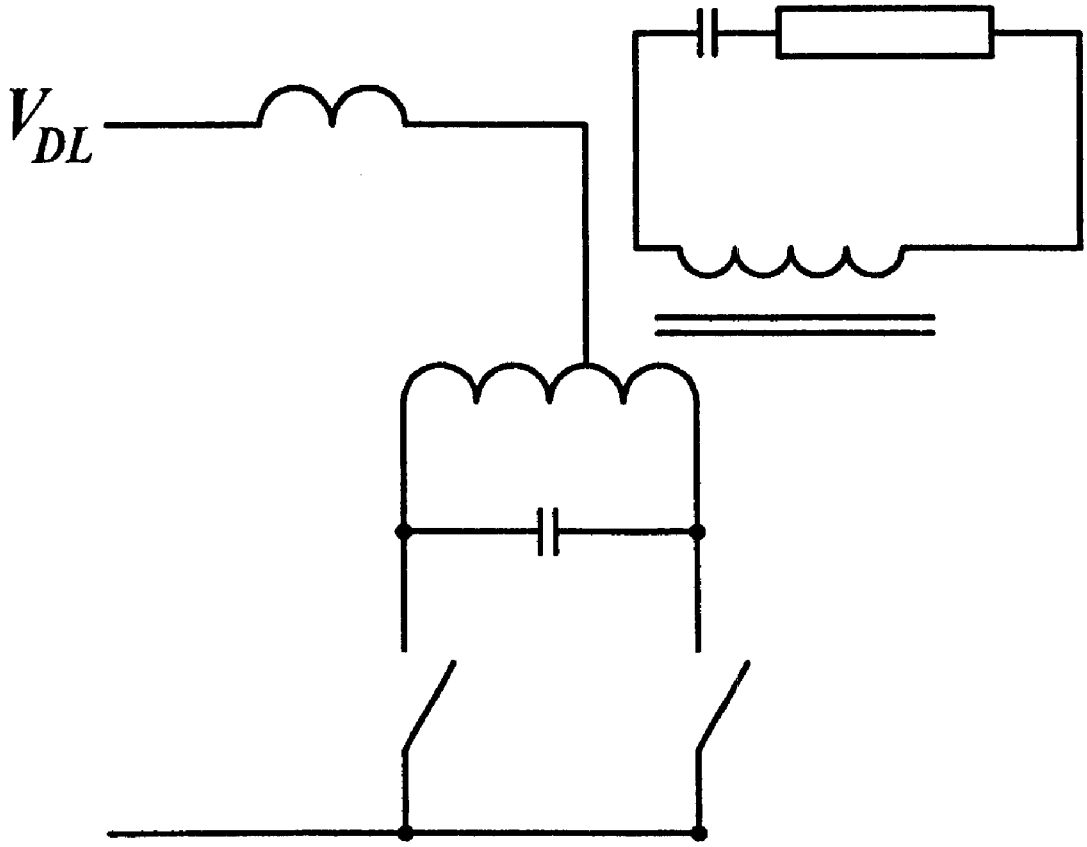
Fig. 1 (PRIOR ART)
FIG. 1 is an exemplary schematic of a Royer oscillator used to drive a discharge lamp.

There are at least three prior art circuits that fail to solve the problem solved by the present invention. As shown in FIG. 1, a current-fed, push-pull (Royer) oscillator may be employed to convert a DC signal input into an AC signal for driving a CCFL. The Royer oscillator usually employs the magnetizing inductance of the step-up transformer's primary winding as an inductor in a filter for the AC signal. The operating frequency of the Royer oscillator is determined by the resonant frequency of a tank circuit formed by the capacitive and inductive components in a load that is coupled across the outputs of the power switches. The sinusoidal shape of the AC signal is dependent upon the Q value for a fully loaded tank circuit. The loaded Q value should be greater than 3 to ensure stable operation and a value between 6 and 10 is typical.

Figure 2:
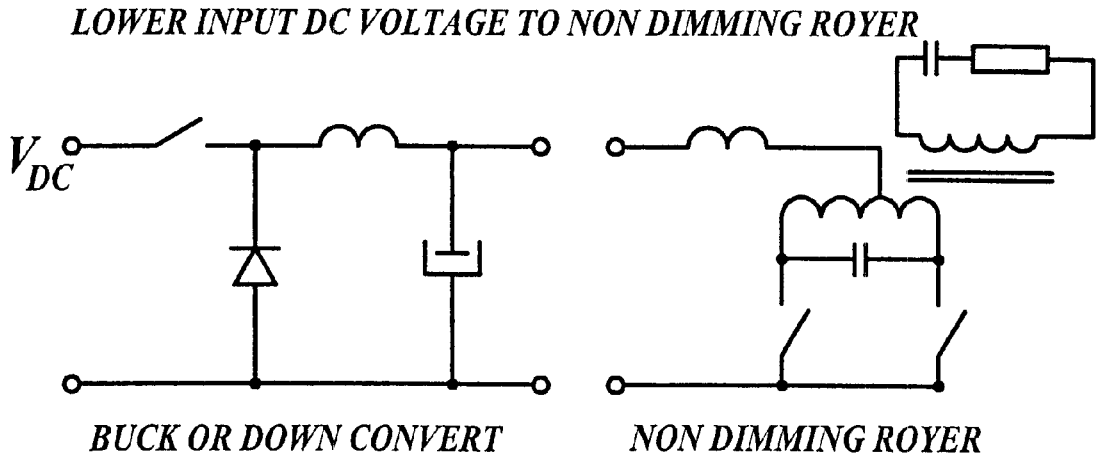
Fig. 2 (PRIOR ART)
FIG. 2 is an exemplary schematic of a dimming Royer that employs a buck mode switching regulator coupled to a Royer oscillator.

The AC output voltage of the Royer circuit is a linear function of the voltage at an inductor coupled to the input. As shown in FIG. 2, one control technique for this circuit regulates the voltage input with a buck-mode switching regulator. In this way, the operating voltage impressed on the secondary winding of the transformer is approximately equal to the strike voltage of the lamp. Also, the current in the lamp is ballasted by a small, high-voltage capacitor in series with the lamp. Typically, the lamp current is sensed with a resistor in series with one lead of the lamp and regulated by varying the average voltage impressed across the inductor at the input.

One characteristic of the Royer oscillator is the presence of a continuous strike voltage across the transformer. Another characteristic is the relatively high Q factor required for the circuit to oscillate which causes a large amount of energy to circulate in the circuit relative to the amount of power delivered to the discharge lamp. Generally, a relatively high current circulates on the primary side of the transformer at a relatively low voltage and a lower current circulates on the transformer's secondary side at a higher voltage. Thus, to reduce the operating temperature of the tank circuit, the transformer tends to be oversized relative to the small amount of power delivered to a running CCFL. Also, the leakage inductance of the transformer may be employed as a ballasting element instead of an output capacitor.

Further, another disadvantage of the Royer oscillator is the use of two power conversion stages, which reduce the efficiency of the circuit. Although not shown, another disadvantage is a reference to ground at one end of the secondary winding is required to measure the flow of current through the lamp.

Figure 3:
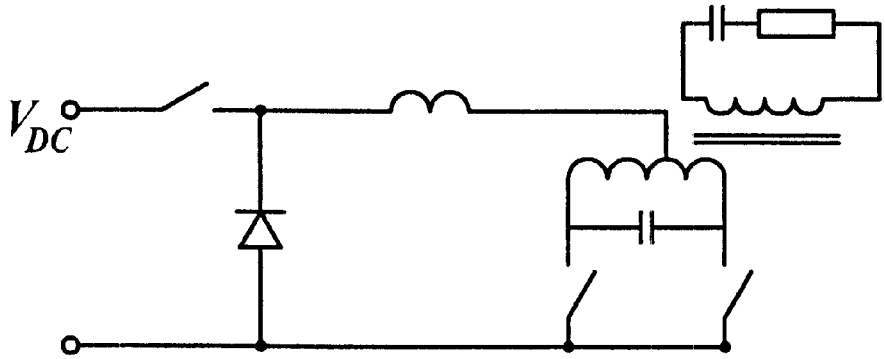
Fig. 3 (PRIOR ART)
FIG. 3 is an exemplary schematic of a dimming circuit coupled to the Royer oscillator for driving the discharge lamp.

In one embodiment of the Royer oscillator, the self oscillating circuit comprises a pair of bipolar power transistors Q1 and Q2, an output transformer, and a resonating capacitor C1, as illustrated in FIG. 3. An inductor L1 is employed as a current source and capacitor C2 is used as an output ballast. This version of a Royer circuit oscillates at the loaded resonant frequency of the network formed by capacitor C1, the output transformer primary winding's magnetizing inductance, and the reflected impedance of the output load, capacitor C2 connected in series with the lamp and the stray capacitances. In order to regulate the lamp power, a power conversion stage is included with the basic Royer circuit. The voltage at the input to inductor L1 is chopped by a transistor switch in series with the input supply, which lowers the average input voltage to the Royer oscillator and reduces the output voltage and CCFL current.

Another type of prior art circuit is the inductive-mode half-bridge (IMHB) for driving a discharge lamp such as a CCFL. This circuit drives a symmetrical square wave into a second-order filter to generate a sine wave output, which can be a very pure sinusoid, depending on the Q value of the filter. The output power is controlled by driving the filter above its resonant frequency (into the inductive region) and the values of the components are chosen such that the filter is driven at resonance only at full output power and the minimum DC input voltage. The current in the lamp is ballasted by a small, high-voltage capacitor connected in series with the lamp. Closed loop regulation is achieved by sampling the lamp current through a resistor in series with one CCFL lead and varying the frequency of the AC output signal.

One disadvantage of the IMHB circuit is that the operating frequency tends to vary with line voltage and the amount of power delivered to the CCFL. Further, the operating frequency is usually not equal to the resonant frequency of the filter. Also, the operating voltage on the secondary winding of the step-up transformer is essentially equal to the strike voltage of the lamp. Additionally, an end of the secondary winding of the transformer must be grounded for the circuit to sense the current flowing through the lamp.

Figure 4:
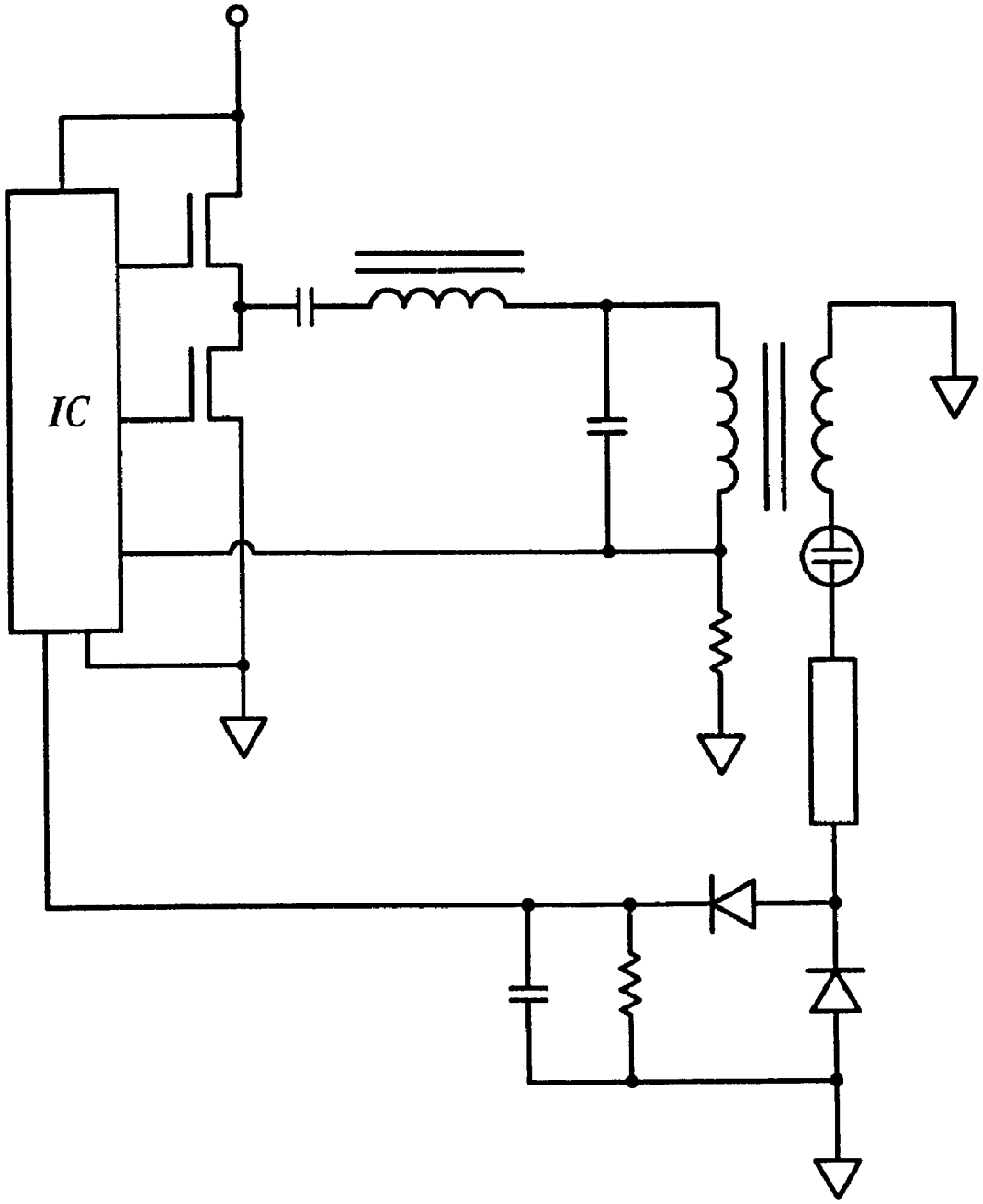
Fig. 4 (PRIOR ART)
FIG. 4 is an exemplary schematic of an inductive mode half bridge circuit coupled to a tank circuit and a current feedback control circuit for driving the discharge lamp.

One implementation of the IMHB circuit employs a half bridge configuration of power switches for implementing a single stage power conversion and providing a dimming function as shown in FIG. 4. A zero voltage switching transition for the output switches is made possible by operating the circuit at a frequency greater than the loaded resonant frequency of the output network. However, operation of the IHMB circuit at the loaded resonant frequency is more desirable because at this point the circuit has the greatest efficiency, i.e., the ratio of delivered power to the total output network volt-ampere product. The IMHB circuit may detect the loaded resonant frequency of the output network, however, the resonance detector is used as a block to prevent the circuit from operating below this frequency. If the IMHB circuit oscillated below the resonant frequency of the tank, the control loop would be inherently unstable and the inverter would cease to function. Thus, the IMHB circuit avoids operating below this point and, except for the condition of lowest input voltage and maximum lamp power, this circuit will operate at a frequency that is greater than the optimum resonant frequency. Also, the operation of the IMHB at greater than the optimum resonant frequency will cause less than maximum efficiency for the circuit.

Another prior art circuit is the constant frequency half-bridge (CFHB) circuit. In this case, the power delivered to the step-up transformer is controlled by changes to the duty cycle of the AC signal driving the CCFL. However, either this signal is filtered with a tank that has a high Q value at the cost of decreasing the efficiency of the circuit, or the CCFL is driven with an AC signal that includes a fairly high crest factor (and high harmonic frequency content). The step-up transformer's secondary winding voltage is essentially equal to the strike voltage at all times and the current through the lamp is ballasted by a small series capacitor. The CCFL current is sensed with a resistor in series with the other lead of the lamp.

One disadvantage of the CFHB circuit is the high crest factor in the AC signal's current waveform, which increases the potential for interference with nearby circuits due to the numerous harmonic frequencies in the AC signal. Other disadvantages of the CFHB are the continuous high voltage stress on the secondary winding of the step-up transformer and the requirement to ground the step-up transformer's secondary winding to measure the current through the lamp. Another disadvantage of the CFHB is the inability to compensate for both large and variable parasities. For example, a parasitic tank circuit is created by the leakage inductance of the transformer and the capacitance of the discharge lamp. This parasitic circuit can have a separate resonant frequency that may attenuate or amplify the output voltage of the tank circuit.

Present Invention

The preferred embodiment of the present invention is an integrated circuit (IC) that includes four power MOSFETs arranged in an H-bridge circuit. The IC in combination with a separate output network inverts a direct current (DC) signal into an alternating current (AC) signal with enough voltage to drive a load such as a discharge lamp. The IC drives the load at the resonant frequency of the output network in combination with the load's capacitive and inductive components for a range of voltages that are provided by a DC power source. Because the present invention operates at the "loaded" resonant frequency of the output network, the IC is highly efficient over its entire range of operation.

The H-bridge circuit generates an AC signal by periodically inverting a DC signal. The control circuitry regulates the amount of electrical power delivered to the load by modulating the pulse width (PWM) of each half cycle of the AC signal. Since the PWM provides for a symmetrical AC signal, even harmonic frequencies in the AC signal are canceled out. By eliminating the even harmonics and generally operating at the resonant frequency of the filter (load), the designed loaded Q value of the filter may be fairly low and losses in the filter may be minimized. Also, since the CCFL is connected directly across the secondary winding of the step-up transformer, except for the fraction of a second required to strike an arc inside the lamp, the step-up transformer's secondary winding generally operates at the run voltage of the CCFL.

Figure 5A:
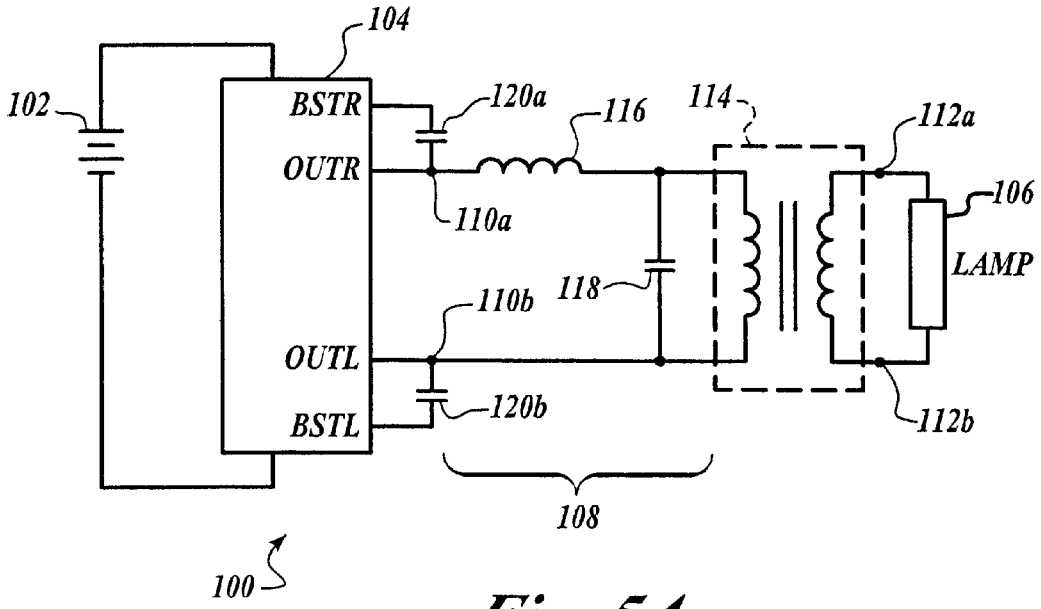
FIG. 5A is an exemplary schematic of a power controlled integrated circuit coupled to a tank circuit on a primary side of a step-up transformer for driving the discharge lamp.

Turning now to FIG. 5A, an exemplary schematic 100 displays the power control embodiment of an integrated circuit 104 (IC) coupled to a load that includes a tank circuit 108 and a lamp 106 such as a CCFL. A DC power supply 102, i.e., a battery, is connected to IC 104 . A boost capacitor 120*a* is connected between a BSTR terminal and an output terminal 110*a*, which is connected to another terminal labeled as OUTR. Similarly, another boost capacitor 120*b* is connected between a BSTL terminal and an output terminal 110*b* that is connected to another terminal identified as OUTL. The boost capacitors 120*a* and 120*b* are energy reservoirs that provide a source of power to operate circuitry inside the IC 104 that can float above the operating voltage of the rest of the circuitry.

An end of inductor 116 is connected to the output terminal 110*a* and an opposite end of the inductor is coupled to an end of a capacitor 118 and an end of a primary winding of a step-up transformer 114. An opposite end of the capacitor 118 is coupled to another end of the primary winding of the step-up transformer 114 and the output terminal 110*b*. An end of a secondary winding for the step-up transformer 114 is connected to a lamp terminal 112*a* and another end of the secondary winding is connected to a lamp terminal 112*b*.

A reactive output network or the "tank" circuit 108 is formed by the components connected between the output terminals 110*a* and 110*b* and the primary winding of the step-up transformer 114. As discussed above, the tank circuit is a second-order resonant filter that stores electrical energy at a particular frequency and discharges this energy as necessary to smooth the sinusoidal shape of the AC signal delivered to the lamp 106.

Figure 5B:
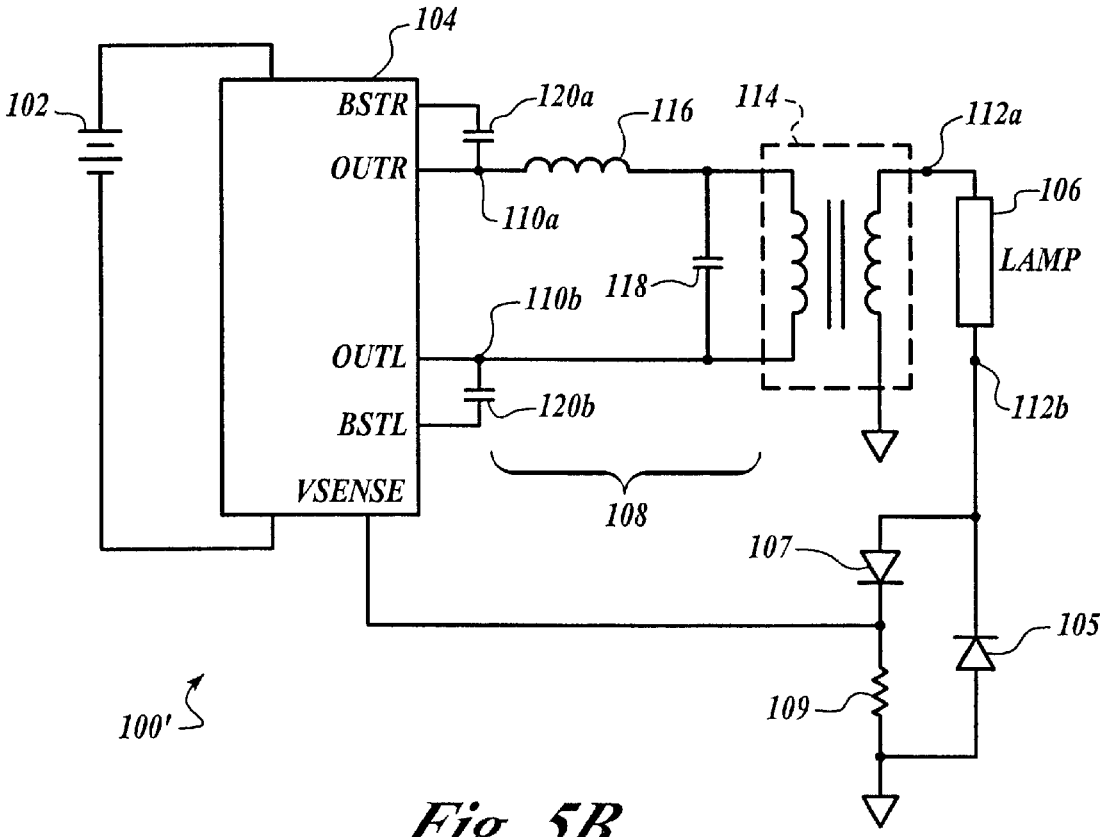
FIG. 5B is an exemplary schematic of a current controlled integrated circuit coupled to another tank circuit on a primary side of the step-up transformer for driving the discharge lamp.

In FIG. 5B, an exemplary schematic 100' displays the current control embodiment of an IC 104' coupled to a load that includes the tank circuit 108 and the lamp 106. Similarly, the battery 102 is connected to the IC 104', the boost capacitor 120*a* is connected between the BSTR terminal and the output terminal 110*a*, and the boost capacitor 120*b* is coupled between the BSTL terminal and the output terminal 110*b*. Also, the end of the inductor 116 is connected to the output terminal 110*a* and its opposite end is coupled to an end of the capacitor 118 and a primary winding terminal of the step-up transformer 114. The opposite end of the capacitor 118 is coupled to the step-up transformer's other primary winding terminal and the output terminal 110*b*. One secondary winding terminals for the step-up transformer 114 is connected to the lamp terminal 112*a* and another end of the secondary winding is directly connected to earth ground. The other lamp terminal 112*b* is coupled to an anode of a diode 107 and a cathode of a diode 105. The cathode of the diode 107 is coupled to an end of a sense resistor 109 and a Vsense terminal at the IC 104'. The anode of the diode 105 is coupled to the other end the sense resistor 109 and earth ground. In this case, the IC 104' monitors the voltage across the sense resistor 109 so that the amount of current flowing into the lamp 106 may be approximated and used to control the amount of electrical power used to drive the lamp.

Figure 6A:
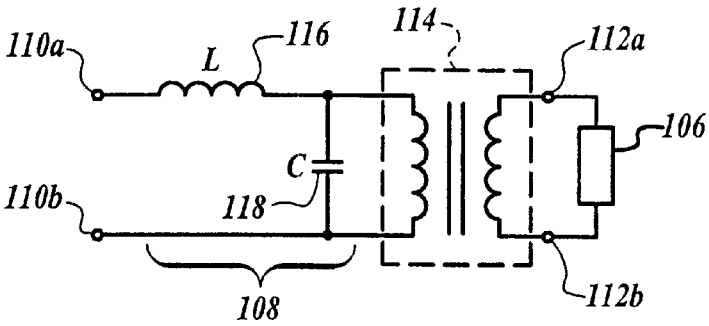
FIG. 6A is an exemplary schematic of the power controlled integrated circuit using a tank circuit disposed on the primary side of the step-up transformer to drive the discharge lamp.

Additionally, it is envisioned that the power and current control embodiments of the invention, i.e., IC 104 and IC 104', may be used with a plurality of different embodiments of the tank circuit. In FIG. 6A, the tank circuit 108 shown in FIGS. 5A and 5B is shown coupled to the IC 104. The tank circuit 108 operates as a filter which is coupled to the primary winding of the step-up transformer 114.

Figure 6B:
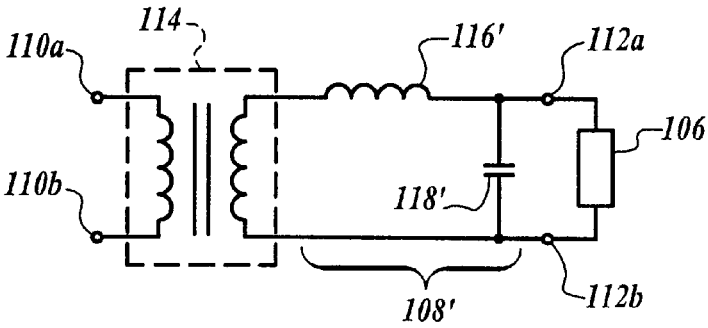
FIG. 6B is another exemplary schematic of the power controlled integrated circuit using another tank circuit disposed on the secondary side of the step-up transformer used to drive the discharge lamp.

In FIG. 6B, another embodiment of a tank circuit 108' is shown. One end of the primary winding for the step-up transformer 114 is connected to the output terminal 110*a* and the other end of the primary winding is connected to the other output terminal 110*b*. An end of an inductor 116' is coupled to one end of the secondary winding for the step-up transformer and another end of the inductor is connected to an end of capacitor 118' and the lamp terminal 1 12*a*. The other end of the secondary winding for the step-up transformer is coupled to another end of the capacitor 118' and the other lamp terminal 112*b*. In this embodiment, the tank circuit 108' has all of the reactive components that form the second order filter disposed on the secondary winding side of the step-up transformer 114.

Figure 6C:
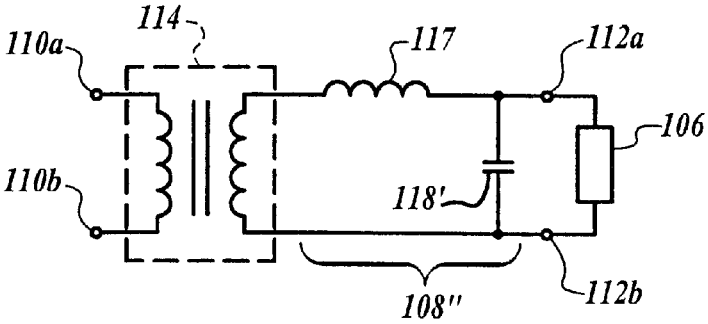
FIG. 6C is another exemplary schematic of the power controlled integrated circuit using another tank circuit disposed on the secondary side of the step-up transformer employed to drive the discharge lamp.

FIG. 6C shows another embodiment of the tank circuit 108" that is similar to the tank circuit 108' illustrated in FIG. 6B. However, the tank circuit 108" does not employ a discrete inductive component to form the second order filter for the tank. Instead, this embodiment uses an inherent leakage inductance 117 of the windings in the step-up transformer 114 as the inductive element of the second order filter. The elimination of a discrete inductive component to implement the second order filter of the tank circuit 108" reduces cost without significant degradation of the performance of the invention.

Figure 6D:
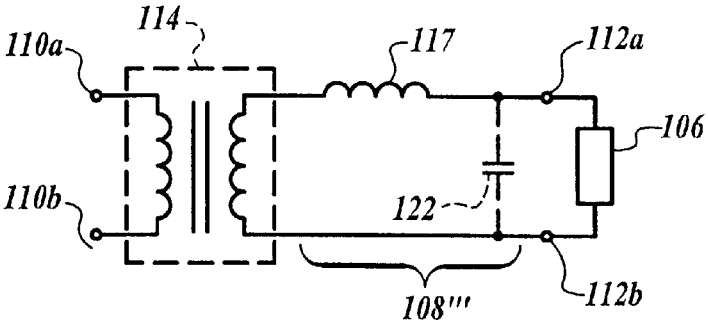
FIG. 6D is another exemplary schematic of another tank circuit disposed on the secondary side of the step-up transformer used to drive the discharge lamp.

FIG. 6D illustrates yet another embodiment of the tank circuit 108'" for further reducing the cost to implement the present invention. In this embodiment, the tank circuit 108'" uses a parasitic capacitance 122 of the lamp wiring (largest source), the secondary winding of the step-up transformer 114 and the transformer's inherent inductance 117 to form the second order filter. One end of the secondary winding for transformer 114 is connected to the lamp terminal 112*a* and the other end of the secondary winding is connected to the lamp terminal 112*b*. This embodiment eliminates the need for discrete inductive and capacitive components to implement a second order filter, and reduces the cost to use the invention to drive the lamp 106.

Figure 6E:
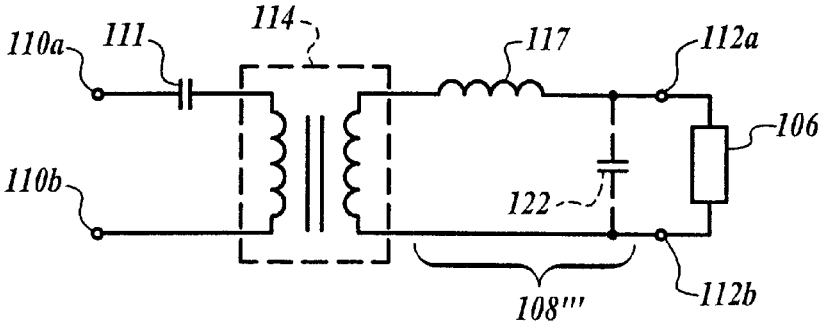
FIG. 6E is another exemplary schematic of another tank circuit that employs a primary coupling capacitor.

FIG. 6E shows another embodiment of the tank circuit 108'" that is substantially similar to the embodiment shown in FIG. 6D. However, in this case, the primary of the transformer 114 is coupled to the output of the IC 104 through a capacitor 111 which is used to cancel out the effect of the transformer's primary magnetizing inductance. The addition of the capacitor 111 causes the resonant frequency at the primary windings of the transformer 114 to more closely match the resonant frequency at the secondary winding of the transformer. In this way, the resonant frequency for the entire circuit, i.e., the tank circuit 108'" and the transformer 114, is brought closer to the resonant frequency at the secondary windings of the transformer.

Additionally, the largest source of parasitic capacitance for the various tank circuits shown in FIGS. 6A–6E is the wiring for the discharge lamp 106. It is also envisioned that a pair of parallel metal plates may be disposed on either side of a circuit board that includes the IC 104 so that a capacitive component is formed for the second order filter (tank circuit).

Figure 7A:
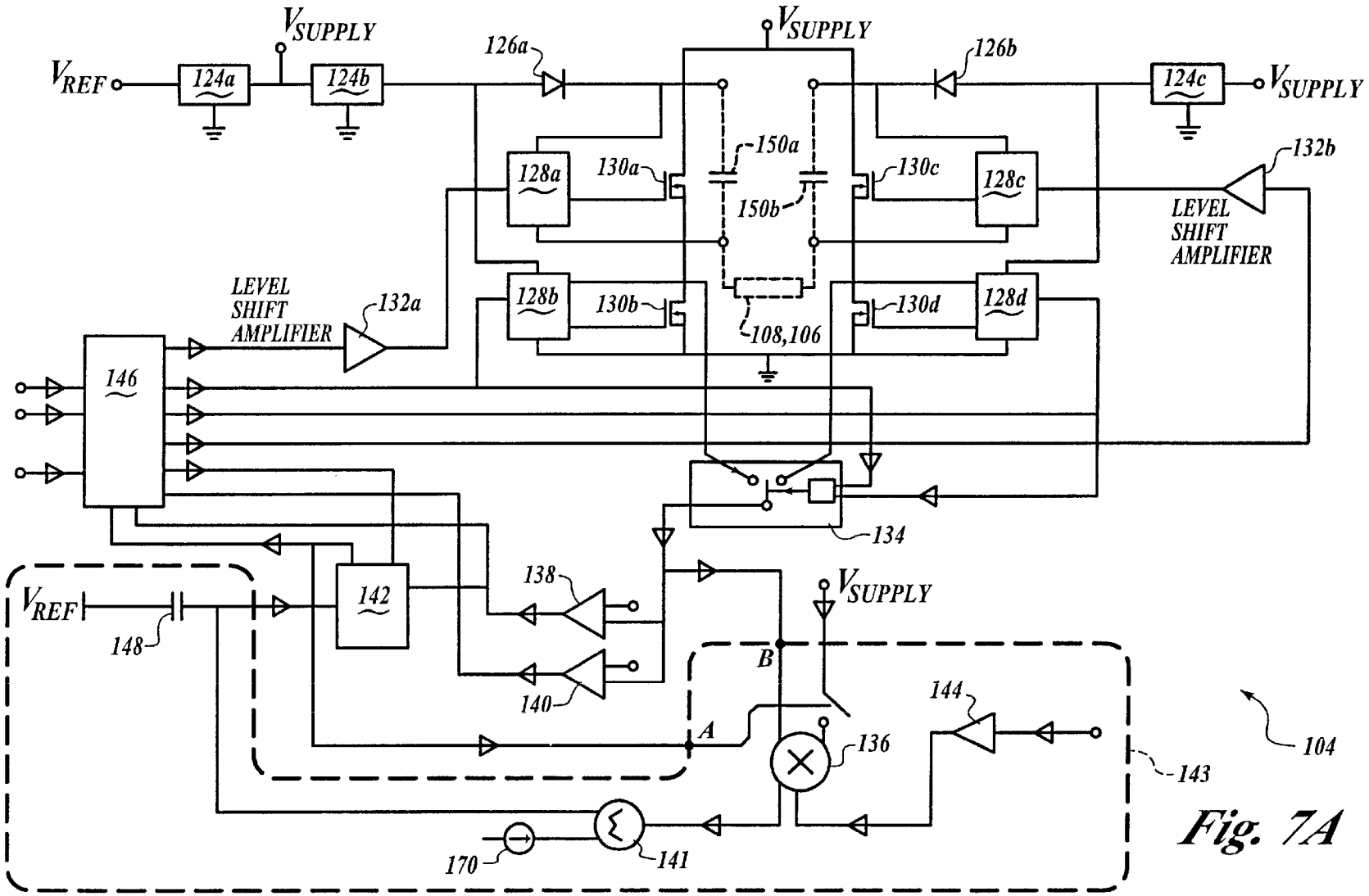
FIG. 7A is an exemplary schematic of a power control integrated circuit for driving the discharge lamp.

FIGS. 7A, 7B, 8 and 9 illustrate the internal circuitry of an integrated circuit (IC) for implementing the different embodiments of the invention. FIG. 7A shows an exemplary schematic of the power control embodiment of the IC 104. A Vref signal is provided as an output from a voltage regulator 124*a* that is coupled to a Vsupply signal. The Vref signal is a bandgap reference voltage which is nominally set to 5.0 Volts and it is used to derive various voltages used by separate components of the IC 104. Several internal voltages for a control logic block 146 are derived from the Vref signal, such as an UVLO (undervoltage lockout) signal and a master voltage reference for a thermal shutdown circuit. Also, the Vref signal derives other voltages that set trip points for a peak current (Ipk) comparator 138, a zero crossing detector 140 and a power control block 136.

A voltage regulator 124*b* is also coupled to the Vsupply signal and provides a regulated 6 Volt DC signal. The output of voltage regulator 124*b* is connected to a gate drive block 128*b* and an anode of a diode 126*a* whose cathode is connected to a gate drive block 128*a* and the BOOST LEFT terminal. Another voltage regulator 124*c* is coupled to the Vsupply signal and it provides a regulated 6 Volt DC signal to a gate drive block 128*d*. The output of the voltage regulator 124*c* is also connected to an anode of a diode 126*b* whose cathode is connected to a gate drive block 128*c* and the BOOST RIGHT terminal. Since the voltage regulators 124*b* and 124*c* separately regulate the voltage supplied to the relatively high power gate drive blocks 128*a*, 128*b*, 128*c* and 128*d*, the operation of any of the gate drive blocks tends to not significantly interfere with the Vref signal outputted by the voltage regulator 124*a*. Also, separate terminals for the gate drive blocks 128*b* and 128*d* are connected to earth ground.

Two level shift amplifiers 132*a* and 132*b*, have their respective input terminals separately connected to a control logic block 146 and their ouput terminals separately coupled to the gate drive blocks 128*a* and 128*c*, respectively. These level shift amplifiers translate the control logic signals from the logic level used in the control logic block 146 to the logic levels required by the gate drive blocks 128*a* and 128*c*, respectively.

An H-bridge output circuit for IC 104 is defined by the four power MOSFETs 130*a*, 130*b*, 130*c* and 130*d*. The drain terminal of the MOSFET 130*a* is coupled to the Vsupply signal and its gate terminal is coupled to gate drive block 128*a*. The source terminal of the MOSFET 130*a* is connected to the OUT LEFT terminal, the gate drive block 128*a*, the drain terminal of the MOSFET 130*b*, the gate drive block 128*b*, and a mux block 134. The source terminal of the MOSFET 130*b* is connected to earth ground and its gate terminal is coupled to the gate drive block 128*b*. Similarly, the drain terminal of the MOSFET 130*c* is connected to the Vsupply signal and its gate terminal is coupled to the gate drive block 128*c*. The source terminal of the MOSFET 130*c* is connected to the OUT RIGHT terminal, the gate drive block 128*c*, the drain terminal of the MOSFET 130*d*, the gate drive block 128*d*, and the mux block 134. Also, the source terminal of the MOSFET 130*d* is connected to earth ground and its gate terminal is coupled to the gate drive block 128*d*.

The source terminals of the MOSFETs 130*b* and 130*d* are coupled to earth ground (low side) and their respective gate drive blocks 128*b* and 128*d* include discrete digital logic components that employ a 0 to 5 Volt signal to control the operation of the associated power MOSFETs. The source terminals of the MOSFETs 130*a* and 130*c* are not connected to earth ground. Instead, these source terminals are connected to the respective OUT LEFT and OUT RIGHT terminals (high side) of the H-Bridge output circuit. In this arrangement, a 0 (earth ground) to 5 Volt signal may not reliably control the operation of the MOSFETs 130*a* and 130*c*. Since the gate drive blocks 128*a* and 128*c* employ discrete digital logic control signals, the invention provides for level shifting these control signals to a voltage that is always higher than the voltage at the source terminals of the associated MOSFETs 130*a* and 130*c*. The source terminal voltages tend to rise along with the voltage impressed across the OUT LEFT and OUT RIGHT terminals of the H-bridge output circuit. The level shift amplifiers 132*a* and 132*b* translate a 0 to 5 Volt logic signal that is referenced to ground into a 0 to 6 Volt logic signal which is referenced to the source terminal of the associated MOSFETs 130*a* and 130*c*. In this way, when the source terminals of the MOSFETs 130*a* and 130*c* have a potential anywhere between 0 Volts and 25 Volts, the gate drive blocks 128*a* and 128*c* are still able to control the operation of their associated MOSFETs.

The gate drive blocks 128*a*, 128*b*, 128*c* and 128*d* along with the level shift amplifiers 132*a* and 132*b* translate the control signals from the control block 146 into a drive signal for each of their associated power MOSFETs in the H-bridge output circuit. The gate drive blocks provide buffering (current amplification), fault protection, level shifting for the power MOSFET control signals, and cross conduction lockout. The gate drive blocks amplify the current of the digital logic signals so that relatively high currents may be provided for the rapid switching of the state of the power MOSFETs between the on (conduction) and off (non-conduction) states. Each of the four power MOSFETs is current limited by its associated gate drive blocks to approximately 5 Amperes when an output fault occurs such as a short from the OUT LEFT terminal and/or the OUT RIGHT terminal to the Vsupply rail or a short to earth ground. Under such an output fault condition, the gate drive block will turn off the associated power MOSFET before any damage occurs.

All four of the power transistors in the preferred embodiment are MOSFETs, and they tend to have a high input capacitance. To quickly switch a power MOSFET between the conduction and non-conduction states, the gate drive block provides for driving large currents into the gate terminal of the respective power MOSFET. The gate drive blocks amplify the small currents available from control signals produced by the discrete digital logic elements in the blocks to a relatively higher current level that is required to quickly switch the state of the power MOSFETs.

When the gate drive block applies a voltage signal (6 volts with respect to the source terminal) to the associated power MOSFET's gate terminal, the MOSFET will turn on (conduct). Also, the power MOSFET will turn off (non-conduct) when zero volts is applied to its gate terminal with respect to its source terminal. In contrast, the source terminals of the two power MOSFETs 130*a* and 130*c* are connected to the respective left output and right output terminals. This configuration causes the source terminal voltage to float for each of these power MOSFETs in a range from earth ground to Vsupply minus the voltage drop across the respective power MOSFET. The gate drive blocks 128*a* and 128*c* apply a level shifted voltage signal to the gate terminal of the associated power MOSFET with a range of zero to +6 volts relative to the floating source terminal voltage. In this way, a 0 to 5 Volt ground-referenced signal from the control block 146 is translated into a 0–6 Volt signal (buffered for high current) relative to the potential at the source terminals of the power MOSFETs 130*a* and 130*c*.

Each of the gate drive blocks also provide logic for controlling the cross conduction lockout of the power MOSFETs. If both an upper and lower power MOSFET, e.g., power MOSFETs 130*a* and 130*b*, are conducting at the same time, then "shoot through" currents will flow from the input power supply to ground which may possibly destroy these power MOSFETs. The gate drive blocks prevent this condition by simultaneously examining the value of the gate terminal voltages for both the upper and lower power MOSFETs. When one of the gate drive blocks (upper or lower) detects an "on" voltage at the gate terminal of the associated MOSFET, then the other gate drive block is locked out from also applying the on voltage to its associated gate terminal.

The gate drive blocks 128*a* and 128*c* provide for initializing a pair of bootstrap capacitors 150*a* and 150*b* during startup (initial energization) of the present invention. Bootstrap capacitor 150*a* is connected between the OUT LEFT terminal and the BOOST LEFT terminal. As discussed above, the OUT LEFT terminal is also connected to the source terminal of the power MOSFET 130*a* and the gate drive block 128*a*. In this way, the bootstrap capacitor 150*a* is charged by the diode 126*a* when the lower power MOSFET 130*b* is conducting and the upper power MOSFET 130*a* is non-conducting. Once charged, the bootstrap capacitor 150*a* will provide a stable turn on voltage to the gate terminal of the upper power MOSFET 130*a* even as the potential at the source terminal of the upper MOSFET is rising to approximately the same potential as Vsupply. Similarly, the bootstrap capacitor 150*b* is connected between the OUT RIGHT terminal and the BOOST RIGHT terminal to perform substantially the same function. Also, the lamp 106 and the tank circuit 108 are coupled between the OUT LEFT terminal and the OUT RIGHT terminal of the H-bridge output circuit.

During initialization, i.e., startup, of the IC 104, the lower power MOSFETs 130*b* and 130*d* are switched on (conduction) by gate drive blocks 128*b* and 128*d* so that charge is simultaneously provided to the bootstrap capacitors 150*a* and 150*b*. When the H-Bridge output circuit begins to oscillate and supply electrical power to the CCFL, the bootstrap capacitors 150*a* and 150*b* will sequentially partially discharge and recharge during the normal switching cycle of the power MOSFETs. The diodes 126*a* and 126*b* automatically recharge their associated bootstrap capacitors 150*a* and 150*b* when their associated power MOSFETs 130*a* and 130*c* are turned off in the switching cycle. In this way, the bootstrap capacitors enable the gate drive blocks 128*a* and 128*c* to provide an adequate and stable turn on voltage to the gate terminals of the associated MOSFETs 130*a* and 130*c*.

The mux block 134 switches between the drain terminals of the power MOSFETs 130*b* and 130*d*, so that the current flowing through the power MOSFETs may be determined by the control logic block 146. The current is determined by measuring the voltage across the power MOSFETs when they are on, i.e., conducting. The measured voltage is directly related to the amount of current flowing through the power MOSFET by its "on" resistance, which is a known value. Since the mux block 134 switches between the drain terminals of the power MOSFET that is turned on, the mux block output voltage is proportional to the current (Isw) flowing through the particular MOSFET that is turned on. The mux block 134 is a pair of analog switches that commutate between the drain terminals of the lower power MOSFETs.

A peak current (Ipk) comparator 138 has an input coupled to the output of the mux block 134 and another input coupled to a predetermined voltage, e.g., 200 mV that is derived from the Vref signal. An output of the peak current comparator 138 is coupled to the control logic block 146 and an on-time timer 142. The peak current comparator 138 output indicates to the control logic block 146 when a predetermined maximum current level has been exceeded. If the lamp 106 is extinguished or broken, the current flowing through the power MOSFETs will build to a relatively high value as the IC 104 tries to drive the requested amount of power or current into the relatively low loss tank circuit components. Since a relatively high current flowing into the tank circuit's capacitor may result in a dangerously high voltage at the secondary of a step-up transformer, the control logic block 146 will turn off the power MOSFET when this condition is indicated by the peak current comparator 138.

An input of a zero crossing detector 140 (comparator) is coupled to the output of the mux block 134 and another input is coupled to a predetermined voltage, e.g., 5 mV that is derived from the Vref signal. The output of the zero crossing detector 140 is coupled to the control logic block 146 for indicating when the current in the tank circuit has almost fallen to zero Amps. The control logic block 146 uses the output of the zero crossing detector 140 to determine when the rest phase should be terminated and initiate the next power phase in the cycle, e.g., power phase A or power phase B as presented in the discussion of FIG. 10 below.

The on-time timer 142 determines the duration of each power phase for the control logic block 146. One input to the on-time timer 142 is coupled to an end of a loop compensation capacitor 148 and the output of the power control block 136. Another end of the loop compensation capacitor 148 is coupled to the Vref signal. The on-time timer 142 determines the period of time (duration) for each power phase in accordance with the value of the voltage on the loop compensation capacitor 148. The on-time timer 142 is separately coupled to an input and an output of the control logic block 146 and the output of the peak current (Ipk) comparator 138. Also, the on-time timer 142 will indicate to the control logic block 146 when the period of time for each power phase has elapsed.

The brightness opamp 144 has an output coupled to a power control (analog multiplier) block 136. An input to the brightness opamp 144 is coupled to a user selectable potentiometer (not shown) for receiving a voltage related to the setting of the potentiometer. When the user selects a control associated with the potentiometer a voltage is impressed by the brightness opamp's output at the power control block 136 that either proportionally increases or decreases in relation to the disposition of the control. Further, as the voltage is changed by the user selecting the control, the on-time timer 142 will indicate a corresponding change in the period of time for each power phase to the control logic block 146.

The power control block 136 provides a signal as an input to a summing node 141 that also inputs a reference current from a constant current (Iref) source 170. The output of the summing node 141 is coupled to the on-time timer 142 and an end of the loop compensation capacitor 148.

The switching of the mux block 134 is coordinated by the control logic block 146, so that only one power MOSFET current at a time is measured. Also, the control logic block 146 measures the currents flowing through the lower H-bridge power MOSFETS 130*b* and 130*d* to synchronize the power phase of the present invention with the current of the tank circuit, determines when the current flowing through the power MOSFETs has exceeded a predetermined maximum peak current (Ipk), and computes the actual power that is delivered to the load.

Generally, there are two types of cycle phases that the control logic block 146 manages, i.e., the power phase and rest phase. The power phase occurs when diagonally opposed power MOSFETs are conducting. For example, power phase A occurs when the power MOSFETs 130*a* and 130*d* are on. Similarly, power phase B occurs when power the MOSFETs 130*b* and 130*c* are on. In both power phases, the control logic block 146 will enable current to flow through the power MOSFETs until one of the following events is indicated: (1) the peak current (Ipk) comparator 138 detects that the maximum current limit is exceeded such as when the discharge lamp is out; (2) the on-time timer 142 has timed out; or (3) the zero crossing detector 140 provides an indication to the control logic block 146 to switch the state of the MOSFETs to the next power phase in the cycle.

In a typical embodiment, when the on-time timer 142 has timed out in power phase A, the control logic block 146 will switch the power MOSFETs to the rest phase. In the rest phase, the lower H-bridge power MOSFETs 130*b* and 130*d* turn on and both upper H-bridge power MOSFETs 130*a* and 130*c* turn off. Although the tank (output) circuit 108 coupled to the OUT LEFT and OUT RIGHT terminals may continue to provide current to the CCFL 106 for a brief period of time, the tank circuit's current will rapidly return to zero at which point the zero crossing detector 140 will indicate this zero current condition to the control logic block 146. Next, the control logic block 146 will direct power MOSFETs 130*c* and 130*b* to turn on and power MOSFETs 130*a* and 130*d* to turn off. The control logic block 146 continuously cycles the power MOSFETs from the power phase A to the rest phase to the power phase B to the rest phase and back to the power phase A at the resonant frequency of the load. The control logic block controls the amount of power/current driving the discharge lamp by varying the amount of time spent resting (rest phase) in relation to the amount time spent adding energy (power phase) to the tank circuit.

Another embodiment provides for the control logic block 146 to use the indication from the peak current comparator 140 to determine when to switch between phases. In this case, the control logic block 146 directs the power MOSFETs to directly toggle (switch) between the A and B power phases so that the rest phase is skipped entirely. In this mode of operation, the current waveform into the tank circuit has a triangular shape because the control logic block 146 actively drives the tank circuit's current back the other way when the peak current comparator 140 indicates that the "peak" current has been reached. This embodiment serves to constrain/control the current provided by the tank circuit 108 and limit the open circuit voltage at the discharge lamp terminals. Either embodiment may be selected during the manufacture of the IC 104 with a simple metal mask option.

There are at least two asynchronous digital logic inputs to the control logic block 146 and they include: (1) a chip enable input for turning the IC 104 on or off; and (2) a thermal shutdown input that provides for internal thermal protection of the IC 104. Another digital input to the control logic block 146 is a multifunctional test/burst input. In product testing of the IC 104, this input is used to halt the execution of the start up initialization steps so that various parameters of the IC may be tested. However, once the product testing is complete, this digital logic input may be used to implement "burst mode" dimming.

In burst dimming mode, the user drives the burst input with a rectangular logic waveform, in one state this input commands the IC 104 to operate normally and deliver power to the lamp 106. In the other state the burst input causes the IC 104 to suspend normal operation and stop delivering power to the lamp 106. The burst input is normally switched off and on at a fast enough rate to be invisible (typically on the order of 180 Hz or greater) for dimming the light emitted by the lamp 106. When the burst dimming mode is asserted, the loop compensation capacitor 148 stops recharging or discharging, i.e., the voltage impressed on the loop compensation capacitor 148 is saved so that the proper power level is quickly resumed when the burst dimming mode is de-asserted. Also, in the burst dimming mode, a relatively greater range of dimming for the lamp 106 is provided than a range provided by a typical analog dimming mechanism because the effect of parasitic capacitances is reduced.

Additionally, full output and analog dimming is supported by the IC 104 with other inputs to the control logic block 146 such as inputs from the peak current (Ipk) comparator 138, the on-time timer 142, and the zero crossing detector 140.

Figure 8:
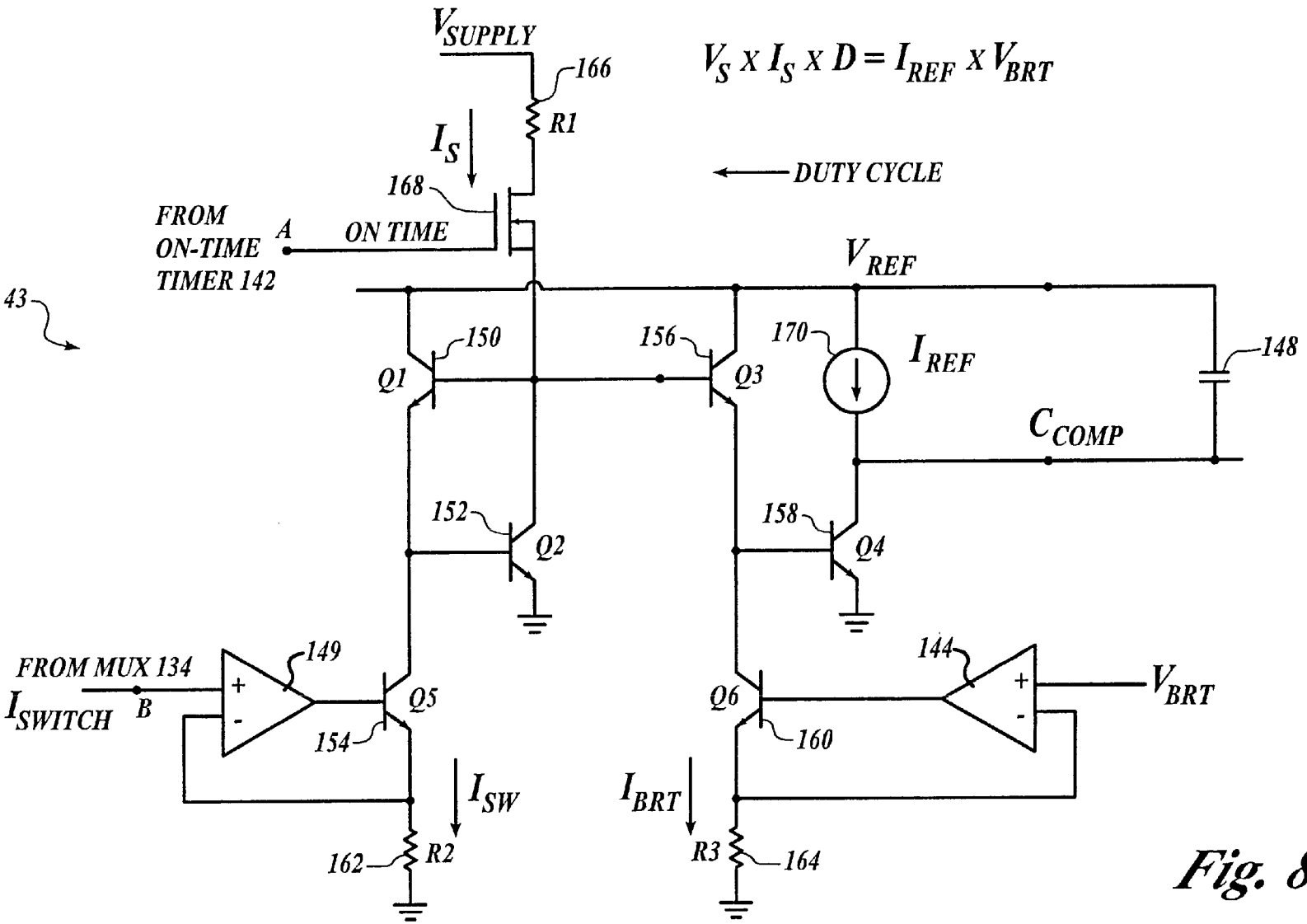
FIG. 8 is an exemplary schematic of a power control block implemented by the power control integrated circuit.

FIG. 8 illustrates an exemplary schematic 143 of the components employed to control the operation of the IC 104 with the amount of power driving the tank circuit 108. Since losses in the tank circuit 108 and the transformer 114 are approximately constant over the entire range of the AC signal driving the load, the input power to the load correlates to the actual power driving the CCFL 106 in the tank circuit 108. Also, the power control block 136 is a metal mask option that must be selected during the manufacture of the IC 104.

Making use of the logarithmic relationship between the base-emitter voltage (Vbe) and collector current (Ic) of a bipolar transistor, a simple multiplier is implemented in the following manner. In one portion of the power control block 136, an end of a resistor 166 is coupled to the Vsupply signal and another end is coupled to a drain terminal of a MOSFET 168. A gate terminal of the MOSFET 168 is coupled to the output of the on-time timer 142 (not shown here). The on-time timer 142 modulates the duty cycle of the current through the MOSFET 168 by controlling the voltage at the gate terminal synchronous with the output power phase waveform. A source terminal of the MOSFET 168 is coupled to a base of an NPN transistor 150, a base of an NPN transistor 156, and a collector of an NPN transistor 152. A collector of the NPN transistor 150 is connected to the Vref signal. An emitter of the NPN transistor 150 is coupled to a base of the NPN transistor 152 and a collector of an NPN transistor 154. An emitter of the NPN transistor 152 is coupled to ground and an emitter of the NPN transistor 154 is coupled to an end of a resistor 162 and an inverting input to an opamp 149. Another end of resistor 162 is connected to ground. Also, a non-inverting input to the opamp 149 is coupled to the output from the mux block 134 (not shown here) and an output of the opamp is coupled to a base of the NPN transistor 154.

In another portion of the power control block 136, an emitter of the NPN transistor 156 is coupled to a base of an NPN transistor 158 and a collector of an NPN transistor 160. An emitter of the NPN transistor 158 is coupled to ground and a collector is coupled an end of the loop compensation capacitor 148 and an output of a constant current (Iref) source 170. The other end of the loop compensation capacitor 148, an input to the constant current (Iref) source 170 and a collector of the NPN transistor 156 are coupled to the Vref signal. An emitter of the NPN transistor 160 is coupled to one end of a resistor 164 and the inverting input to the brightness opamp 144. Another end of the resistor 164 is connected to ground. A base of the NPN transistor 160 is coupled to an output of the brightness opamp 144. Although not shown, the non-inverting input to the brightness opamp 144 is coupled to a potentiometer for enabling a user to "dim" the amount of light emitted by the lamp 106.

In the following analysis (description) of the operation of the power control block 136, certain quantities may be neglected, compared to other, more significant quantities without compromising the results of the analysis. In particular, the various NPN transistor base currents are neglected compared to the NPN transistor collector currents. Also, the supply voltage is assumed to be large compared to the sum of the base-emitter voltages of the NPN transistor 150 and the NPN transistor 152.

The power control block 136 determines the amount of power delivered to the load by measuring a corresponding amount of power drawn from the power supply. Also, the current either into or out of the loop compensation capacitor 148 is the difference of a constant and a multiply and divide performed in the power control block 136.

During a power phase, the first multiplication is created when the on-time timer 142 supplies the turn on voltage to the gate terminal of the MOSFET 168 which causes the NPN transistors 150 and 152 to conduct and provide a turn on voltage to the base of the NPN transistor 156. Also, the opamp 149 will cause the NPN transistor 154 to conduct a current proportional to the output power switch current when the mux block 134 has switched a drain terminal voltage (Vswitch) from the selected lower power MOSFET to the input of the opamp.

The collector current of the NPN transistor 150 is equal to the collector current of the NPN transistor 154. Similarly, the collector current of the NPN transistor 152 is equal to the supply voltage (Vsupply) divided by the resistor 166. The base-emitter voltage of the NPN transistor 150 is proportional to the logarithm of the current in the output switch. Similarly, the base-emitter voltage of the NPN transistor 152 is proportional to the logarithm of the supply voltage. Thus, the voltage (with respect to ground) at the base terminal of the NPN transistor 150 is proportional to the logarithm of the product of Vsupply times Iswitch. It is important to note that this voltage is chopped, i.e., gated, by the duty cycle of the output waveform.

The voltage at the base of the NPN transistor 150 is equal to the voltage at the base terminal of the NPN transistor 156. The collector current of the NPN transistor 160 is proportional to the (externally-provided) brightness control voltage. Also, the collector current of the NPN transistor 156 is equal to the collector current of the NPN transistor 160. Furthermore, the base-emitter voltage of the NPN transistor 156 is proportional to the logarithm of the brightness control voltage. Thus, the voltage (with respect to ground) at the base terminal of the NPN transistor 158 is proportional to the logarithm of (Vsupply*Iswitch/Vbright).

The collector current of the NPN transistor 158 must be proportional to the anti-logarithm of its base voltage, i.e., the collector current of the NPN transistor 158 is proportional to (Vsupply*Iswitch/Vbright). The collector current of the NPN transistor 158 is averaged by the loop compensation capacitor 148. The action of the control loop ensures that the average of the collector current of the NPN transistor 158 is equal to the constant current (Iref) source 170.

For example, when (Vsupply*Iswitch*duty cycle)> (Iref*Ibrt), extra current flows into the loop compensation capacitor 148 at the COMP terminal from the constant current (Iref) source 170, which has the effect of shortening the duty cycle provided by the on-time timer 142 and reducing the power supplied to the load. However, if (Vsupply*Iswitch*duty cycle)<(Iref*Ibrt), the loop compensation capacitor 148 will discharge slightly and the on-time timer 142 will increase the length of the duty cycle until the power drawn from the Vsupply is equal to the power demanded by the control voltage at the non-inverting input to the brightness amplifier. The integrated circuit 104 modulates the duty cycle on the MOSFET 168 and the power MOSFETs 130*a*, 130*b*, 130*c* and 130*d* until the voltage on the COMP terminal stops changing. In this way, negative feedback at the COMP terminal is used to modulate the duty cycle provided by the on-time timer 142.

Figure 9:
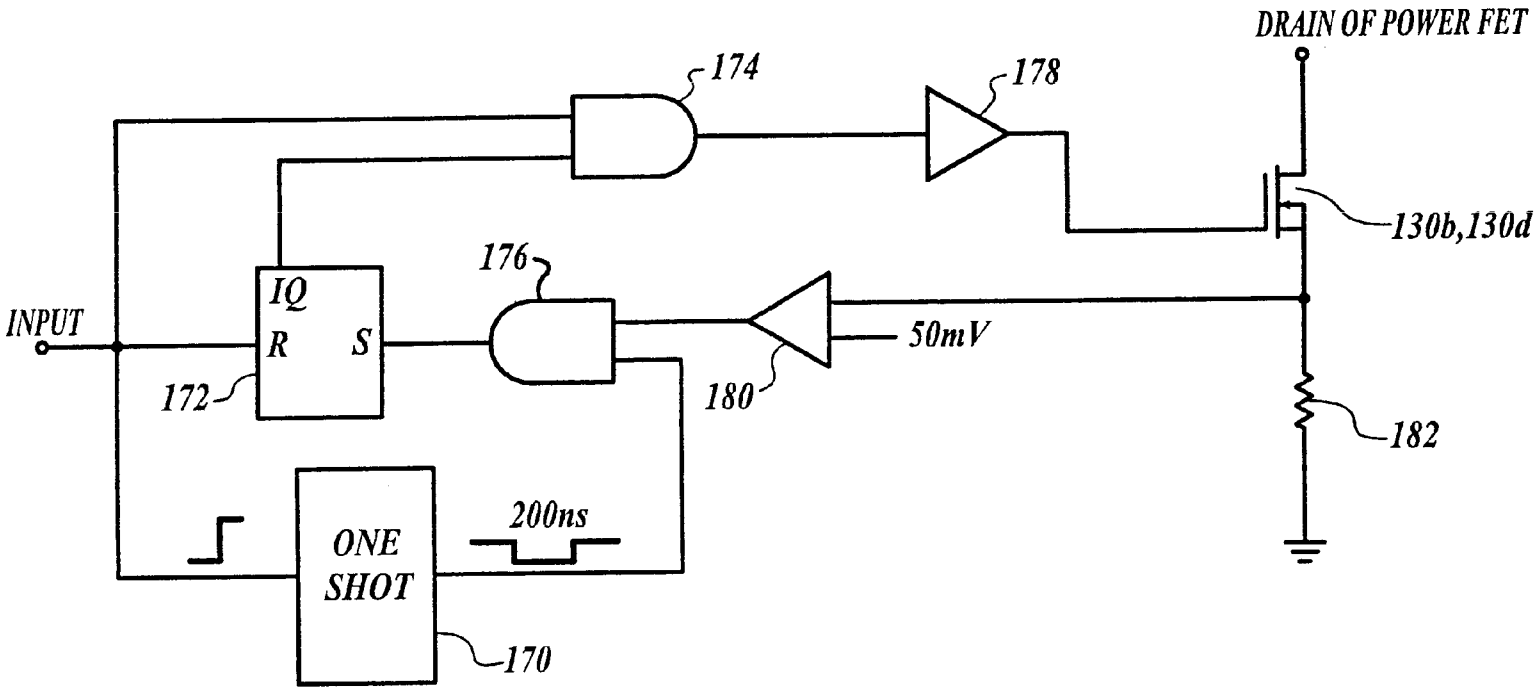
FIG. 9 is an exemplary schematic of a gate drive block implemented by the current control and power control integrated circuits.

FIG. 9 shows how, in addition to buffering the low current logic signals, an exemplary gate drive block 128*b* may also provide a local current limit for the associated power MOSFET 130*b* while it is on. An input to the gate drive block 128*b* is coupled to an input of a one shot timer 170, a reset input to an R-S flip-flop 172 and an input to an AND gate 174. An output of the flip-flop 172 is coupled to another input to the AND gate 174 and the set input of the flip-flop is coupled to an output of an AND gate 176. The output of AND gate 174 is coupled to an input of an inverter 178 that has an output connected to the gate of the MOSFET 130*b*. An output of the one shot timer 170 is connected to an input to the AND gate 176. A current limit comparator 180 has an output connected to another input to the AND gate 176. One input to the comparator 180 is coupled to an approximately 50 millivolt signal derived from the Vref signal and another input is coupled to the source terminal of the MOSFET 130*b* and an end of a resistor 182. The value of the resistor 182 is sized to provide a predetermined voltage at the input to the comparator 180 when five or more Amps of current are flowing through the resistor to ground.

The one shot timer 170 provides a signal approximately 200 nanoseconds after the power MOSFET 130*b* has turned on during the power phase (long enough for the switching noise to stop). The output signal of the one shot timer 170 enables the output of the current limit comparator 180 to be provided by the AND gate 176 to the set input of the flip-flop 172. If the output of the current limit comparator 180 indicates that the current limit voltage on the resistor 182 has been reached, the flip-flop will output a turn-off signal to the AND gate 174 which in turn outputs the turn-off signal to the inverter 178 so that a turn off voltage is applied to the gate terminal of the MOSFET 130*b*. In this way, the power MOSFET 130*b* is immediately turned off for the remainder of a power phase when a current greater than five Amps flows through the power MOSFET. Similarly, the gate drive block 128*d* provides for limiting the current flow through the MOSFET 130*d* in substantially the same way.

Figure 7B:
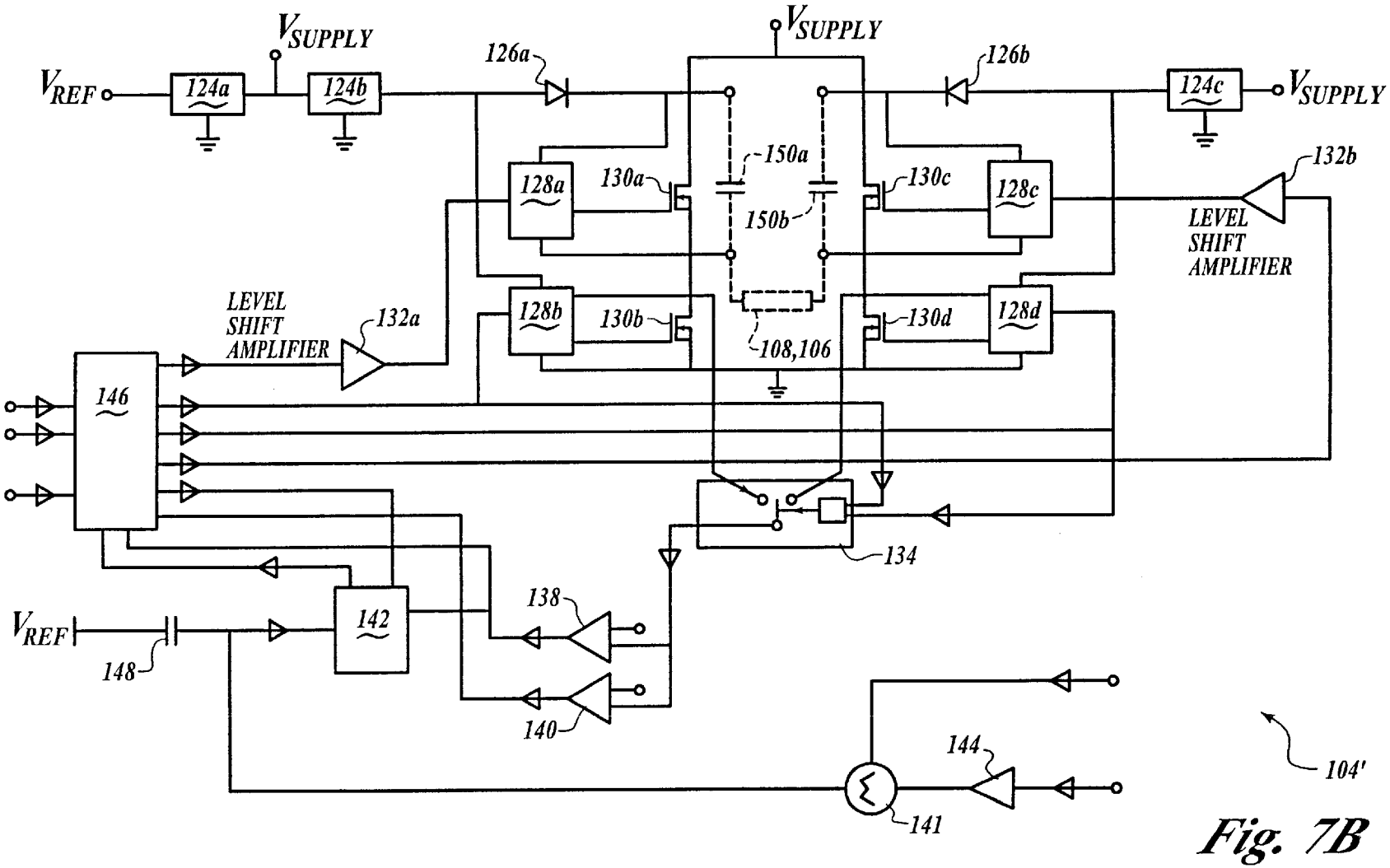
FIG. 7B is an exemplary schematic of a current controlled integrated circuit for driving the discharge lamp.

FIG. 7B shows an exemplary schematic of a current control embodiment of the invention as implemented by an IC 104'. Although the schematic of the current control IC 104' is similar to the power control IC 104, there are some differences. Since current control is employed by the IC 104' to regulate the electrical power supplied to the lamp 106, the power control block 136 is not provided in the IC 104'. Also, the output of the brightness opamp 144 is provided to the summing node 141 which also receives an Isense current through a connection to the sense resistor 109 as shown in FIG. 51. Similarly, the output of the summing node 141 is provided to the end of the loop compensation capacitor 148 and the on-time timer 142. The current through the sense resistor 109 proportionally approximates the amount of current flowing through the lamp 106. The IC 104' uses this approximation to control the amount of electrical power driving the lamp 106.

The current control version of the IC 104' uses the brightness opamp 144 to convert the user input at the potentiometer into a current (Ibright) that the summing node 141 compares to the Isense current and the current difference flows either into or out of the loop compensation capacitor 148. In contrast, the power control version of the IC 104 performs the following generalized steps: (1) employ the brightness opamp 144 to convert the user input into the Ibright current; (2) use the analog multiplier to logarithmically add (multiply) currents proportional to the Iswitch current, Vsupply and the duty cycle; (3) employ the analog multiplier to logarithmically subtract (divide) the Ibright current from the logarithmically added currents; (4) compare the result of the antilogarithm of the subtraction to the Ireference current to determine a differential current; and (5) employ the differential current to either charge or discharge the compensation capacitor 148 so that the on-time timer 142 will adjust the time interval of each power phase relative to the voltage impressed across the loop compensation capacitor 148 by the amount of stored charge.

Figure 10:
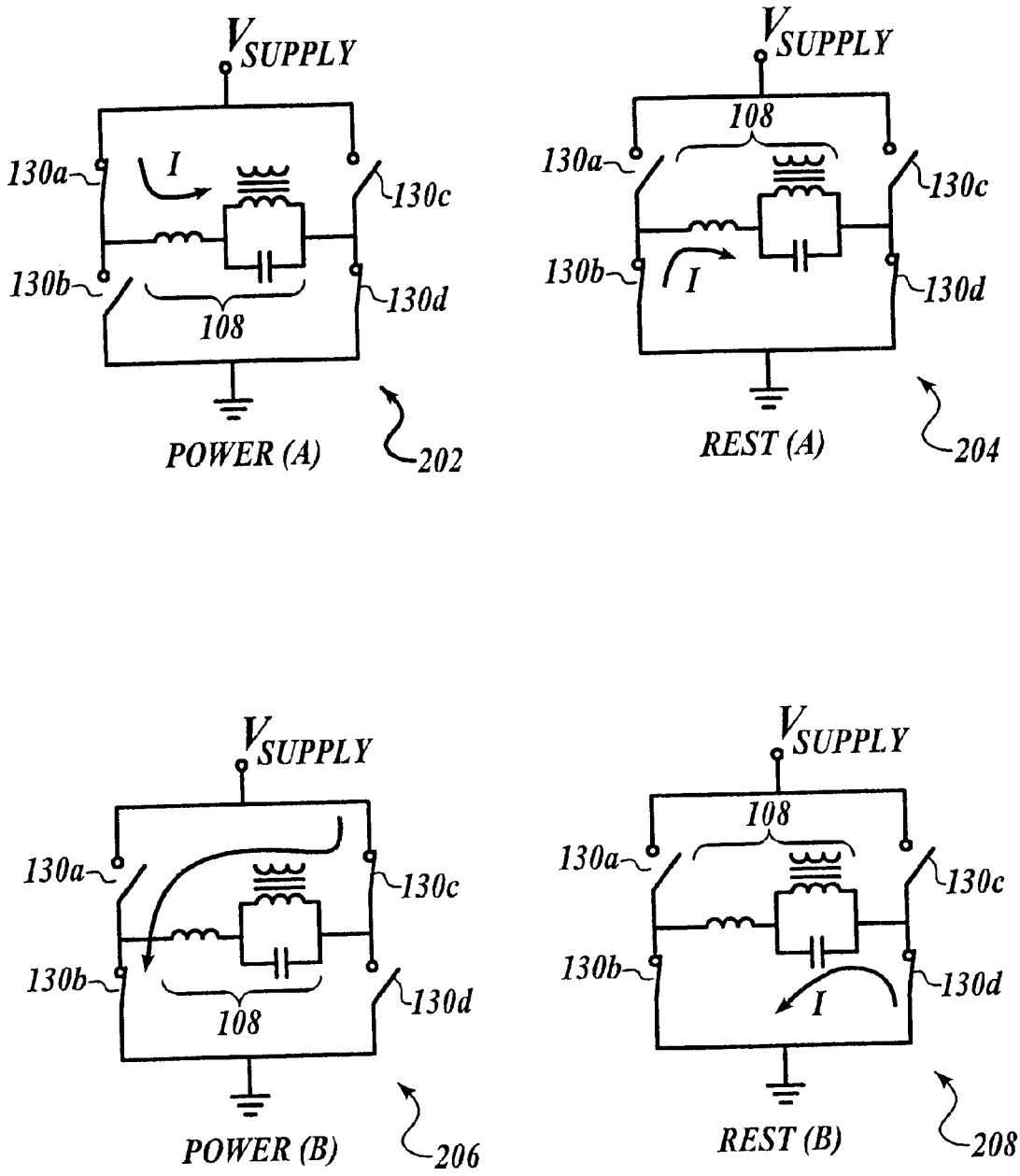
FIG. 10 is an exemplary overview of the various phases of the oscillation cycle of the invention.

Looking now to FIG. 10, a schematic overview 200 shows the present invention configured in four operational modes or phases that complete a cycle for driving a load with an AC signal. All four phases, i.e., a power phase "A" 202, a rest phase "A" 204, a power phase "B" 206, and a rest phase "B" 208, employ the same components. The power MOSFETs 130*a*, 130*b*, 130*c* and 130*d* are illustrated as discrete switches. When a power MOSFET is on (conducting), it is represented as a closed switch. Also, when the power MOSFET is off (non-conducting), it is represented as an open switch. In this way, the state of conduction for the power MOSFETs may be more clearly illustrated for the different phases of the cycle.

An end of the power transistor 130*a* is connected to the Vsupply terminal and the other end is coupled to an end of the power transistor 130*b* and an end of the tank circuit 108. One end of the power transistor 130*c* is connected to the Vsupply signal (DC supply) and the other end is connected to the other end of the tank circuit 108 and one end of the power transistor 130*d*. The other ends of power transistors 130*b* and 130*d* are connected to ground.

As illustrated in power phase "A" 202, diagonally opposite power transistors 130*b* and 130*c* are off (open position) and power transistors 130*a* and 130*d* are on (closed position). A DC current from the Vsupply terminal flows through the power transistor 130*a*, passes through the tank circuit 108 and returns to earth ground through power transistor 130*d*.

When the flow of current from the Vsupply terminal is at least equal to a predetermined peak value as indicated by the peak current comparator 138 or the on-time timer 142 has finished, the power transistors will switch from power phase "A" 202 to the configuration identified as rest phase "A" 204. However, if neither of these conditions has occurred and the tank current has returned to the zero crossing point as indicated by the zero crossing detector 140, the power transistors will bypass the rest phase "A" and switch directly to the configuration identified as a power phase "B" 206. Typically, the bypassing of the rest phase will occur when there is a high load and a relatively low Vsupply voltage.

Rest phase "A" 204 is shown with the top laterally opposite power transistors 130*a* and 130*c* disposed in the open position (off) and the bottom laterally opposite power transistors 130*b* and 130*d* configured in the closed position (on). In the rest phase "A" 204 configuration, the tank circuit 108 discharges stored energy, i.e., a current, through power transistor 130*d* to ground. After the tank circuit has discharged at least a portion of its stored energy, the power transistors switch to the configuration identified as the power phase "B" 206. The present invention provides for tracking the resonant frequency of the tank circuit and switching the power transistors at this frequency, so that the tank circuit will store energy during the power phase "A" 202 and discharge this energy during the rest phase "A". In this way, the AC signal impressed across the load coupled to the tank circuit has a relatively smooth sinusoidal shape for the "A" portion of the AC signal cycle.

Similarly, the power phase "B" 206 illustrates diagonally opposite power transistors 130*a* and 130*d* disposed in an open position and power transistors 130*b* and 130*c* in a closed position. A current from the Vsupply terminal flows through the power transistor 130*c*, passes through the tank circuit 108 and returns to ground through power transistor 130*b*. When the flow of current from the Vsupply terminal is at least equal to a predetermined peak current value indicated by the peak current comparator 138 or the on-time timer 142 has timed out, the power transistors switch from the power phase "B" 206 to the configuration identified as the rest phase "B" 208.

Rest phase "B" 208 is shown with top laterally opposite power transistors 130*a* and 130*c* disposed in the open position and the power transistors 130*b* and 130*d* configured in the closed position. In the rest phase "B" 208, the tank circuit 108 will discharge stored energy, i.e., a current, through power transistor 130*b* to ground so that the AC signal impressed across the load coupled to the tank circuit has a smooth sinusoidal shape for the "B" portion of the AC signal cycle. After discharging the stored energy for a period of time, the power transistors will switch to the power phase "A" configuration and the cycle of phases will repeat. In this way, power is transferred to the load continuously throughout the cycle (both power and rest phases) and the stored energy in the tank circuit 108 is replenished during each power phase.

The present invention provides for dimming a lamp, i.e., reducing the amount of power delivered to the load, by decreasing the period of time that the power transistors are disposed in the power phase "A" and the power phase "B" configuration and proportionally increasing the period of time that the transistors are disposed in the rest phase "A" and the rest phase "B" positions.

Under normal operating conditions, the lamp current (or power) is measured and compared in a feedback loop to the user input (setting of the potentiometer). An error (difference) between the measured value of the lamp current and the user input is employed to determine the value of the voltage across the loop compensation capacitor 148 that is subsequently employed by the on-time timer 142 to determine the length of time that the power transistors are turned on for the power phases. In this way, the user may control the brightness of the lamp 106 over a relatively large range by adjusting the setting of the potentiometer.

Figures 11A, 11B, 11C, 11D:
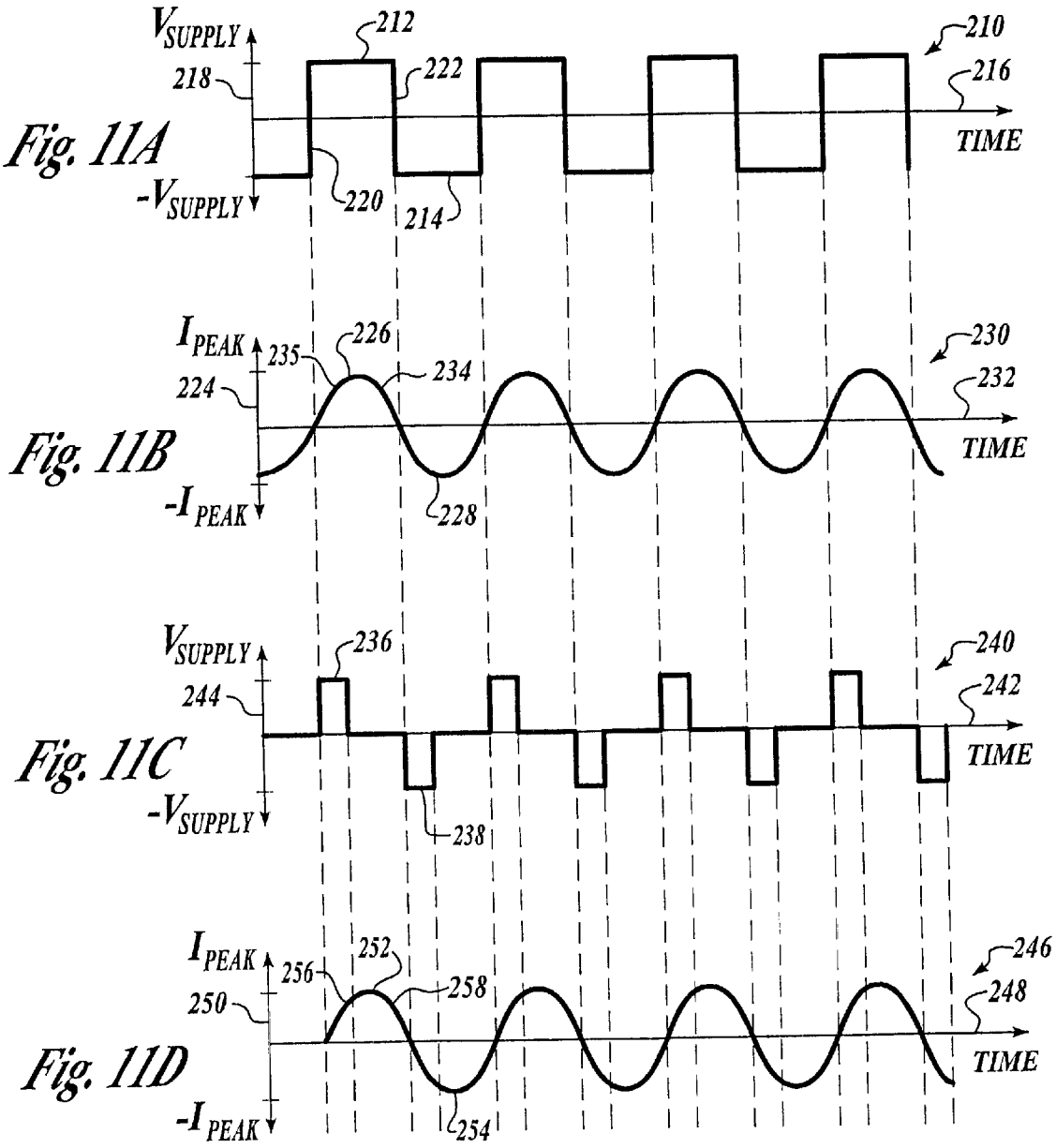

FIG. 11A includes four graphs that illustrate the correspondence between a AC voltage signal generated by the present invention and the current supplied to the load, i.e., the CCFL, under maximum power and reduced power conditions. In a top row graph 210, a horizontal time axis 216 and a vertical voltage axis 218 are shown. As is typical of an H-bridge configuration, the peak voltage amplitude 212 and 214 is equal to the voltage provided by the power supply and the peak-to-peak load voltage is twice the supply voltage. A substantially straight, vertical rising edge 220 occurs at the zero crossing of the tank circuit's current each time the negative waveform 214 transitions to the positive waveform 212. Similarly, a vertical falling edge 222 occurs when the power phase terminates for one of the three reasons that power phases terminate as discussed above. Additionally, the graph 210 shows the voltage waveform shape when the IC 104 is delivering the maximum power/current to the tank circuit for each of the half cycles of the tank's resonant frequency. Typically, this waveform is observed when the circuit is delivering design maximum power to the load at design minimum supply voltage.

In a second row graph 230, a horizontal time axis 232 and a vertical current axis 224 are displayed that correspond to the voltage waveform illustrated in the graph 210. The maximum value of the positive current waveform 226 is equal to a positive peak current value. Similarly, the maximum value of the negative current waveform 228 is equal to a negative peak current value. A rounded falling edge 234 occurs at the resonant frequency of the tank circuit 108 when the positive current waveform 226 has finished charging up the circuit. Similarly, a rounded rising edge 235 occurs at the resonant frequency of the tank circuit 108 when the circuit is just beginning to charge up.

In a third row graph 240, a horizontal time axis 242 and a vertical voltage axis 244 are displayed. The peak voltage amplitude delivered to the load by the voltage waveforms 236 and 238 are equal to the supply voltage and the peak-to-peak load voltage is twice the supply voltage. In graph 240, the duty cycles of both the positive-going waveforms 236 and the negative-going waveforms 238 have been reduced to about one third of the maximum duty cycle (100%). The graph 240 illustrates trailing-edge modulation of the duty cycle of the driving waveform, i.e., the leading edge of the voltage pulse of both polarities occurs near the zero-crossing of the current waveform for all values of the duty cycle. Also, graph 240 shows the case of the voltage provided by the power supply not delivering the maximum power capacity of the H-bridge circuit such as when the lamp is dimmed or the power supply voltage is higher than the design minimum value. In contrast, the graph 210 shows the case of the maximum amount of delivered power matching the maximum capacity of the tank circuit.

In a fourth row graph 246, a horizontal time axis 248 and a vertical current axis 250 are displayed that correspond to the voltage waveform illustrated in the graph 240. The maximum value of a positive current waveform 252 is equal to the positive peak current value. Similarly, the maximum value of a negative current waveform 254 is equal to the negative peak current value. A rounded rising edge 256 occurs at the resonant frequency of the tank circuit 108 when the positive current waveform 252 is charging up the circuit and when the circuit initially begins to discharge current to the load. Similarly, a rounded falling edge 258 occurs when the tank circuit 108 starts to discharge less current to the load. It is important to note that the tank circuit provides for smoothing the current waveform provided to the load when the voltage waveform is operating at less than a 100% duty cycle. The voltage waveform pulses shown in graph 240 pulse at the zero crossing point of the current waveform illustrated in the graph 246 so that the amount of energy delivered to the tank is controlled.

FIG. 11B includes two graphs that illustrate the correspondence between a leading edge modulation of the AC voltage signal generated by the present invention and the current supplied to the load, under reduced power conditions. The leading edge modulation of the AC voltage signal may be used in substantially the same manner as indicated in FIG. 11A for the trailing edge AC voltage signal. For leading edge modulation, the AC voltage signal is turned on sometime after the zero crossing point of the AC current waveform has occurred and turns off at its next zero crossing point.

In a top row graph 241, a horizontal time axis 247 and a vertical voltage axis 245 are shown. The peak voltage amplitude delivered to the load by the voltage waveforms 237 and 239 are equal to the supply voltage and the peak-to-peak load voltage is twice the supply voltage. In graph 241, the duty cycles of both the positive-going waveforms 237 and the negative-going waveforms 239 have been reduced to about one third of the maximum duty cycle (100%). Also, graph 241 shows the case of the voltage provided by the power supply not delivering the maximum power capacity of the H-bridge circuit such as when the lamp is dimmed or the power supply voltage is higher than the design minimum value.

In a bottom row graph 247, a horizontal time axis 249 and a vertical current axis 251 are displayed that correspond to the voltage waveform illustrated in the graph 241. The maximum value of a positive current waveform 253 is equal to the positive peak current value. Similarly, the maximum value of a negative current waveform 255 is equal to the negative peak current value. A rounded rising edge 257 occurs at the resonant frequency of the tank circuit 108 when the positive current waveform 253 is charging up the circuit and when the circuit initially begins to discharge current to the load. Similarly, a rounded falling edge 259 occurs when the tank circuit 108 starts to discharge less current to the load. The voltage waveform pulses shown in graph 241 pulse before the zero crossing point of the current waveform illustrated in the graph 247 so that the amount of energy delivered to the tank is controlled.

In FIG. 12, a graph 260 illustrates the double-sided phase modulation of the AC voltage signal. A vertical voltage (Vab) axis 264 and a horizontal time axis 262 are displayed that correspond to the voltage waveform illustrated in graph 260. In the H-bridge, the peak voltage positive and negative waveforms 266 and 268 are equal to the supply voltage and the peak-to-peak voltage is twice the supply voltage. In a second graph 271, a horizonal time axis 267 and a vertical current axis 265 are displayed which correspond to the voltage waveform illustrated in graph 260. The maximum value of a positive current waveform 270 is equal to the positive peak current value. Similarly, the maximum value of a negative current waveform 269 is equal to the negative peak current value. Additionally, since double-sided phase modulation centers the voltage waveform at the peak of the corresponding current waveform, the present invention provides for either increasing or decreasing the width (both sides) of the voltage waveform in relation to the amount of power delivered to the load.

Figures 13A, 13B, 13C, 13D:
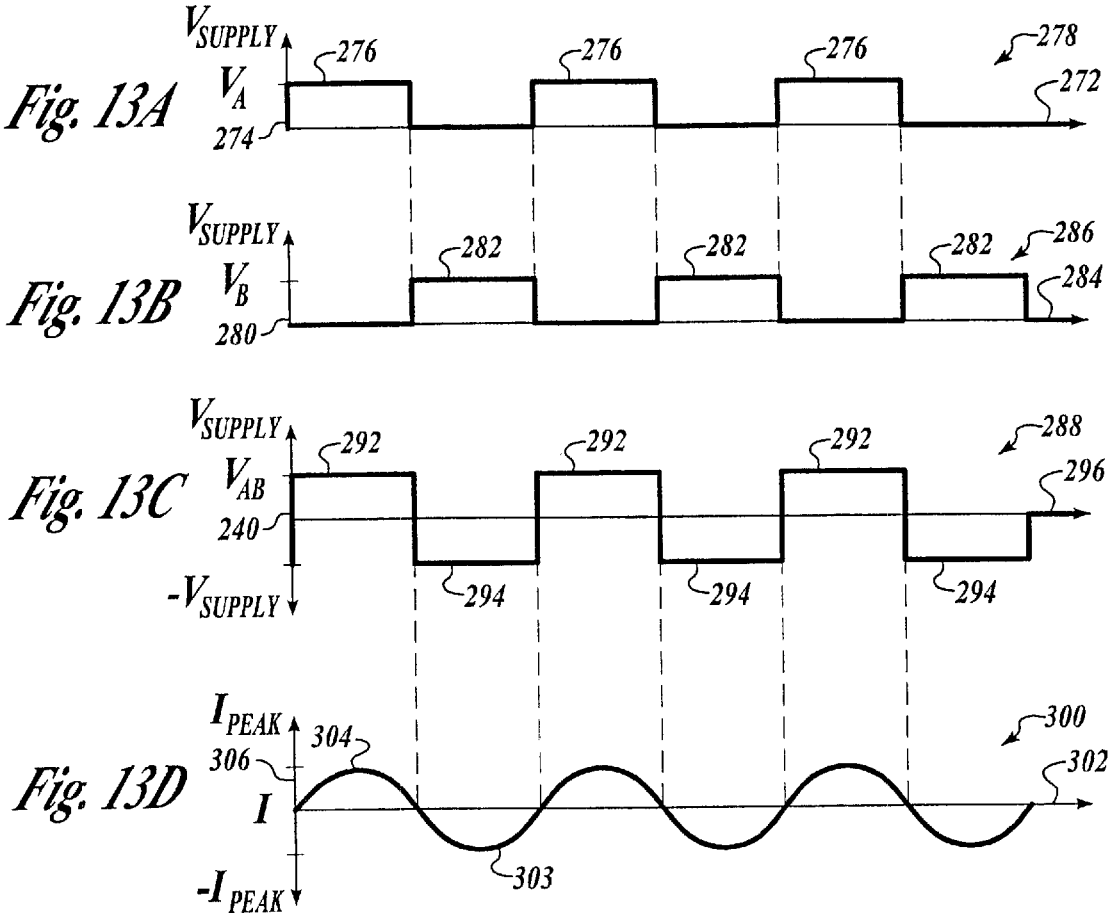
Figures 13E, 13F, 13G, 13H:
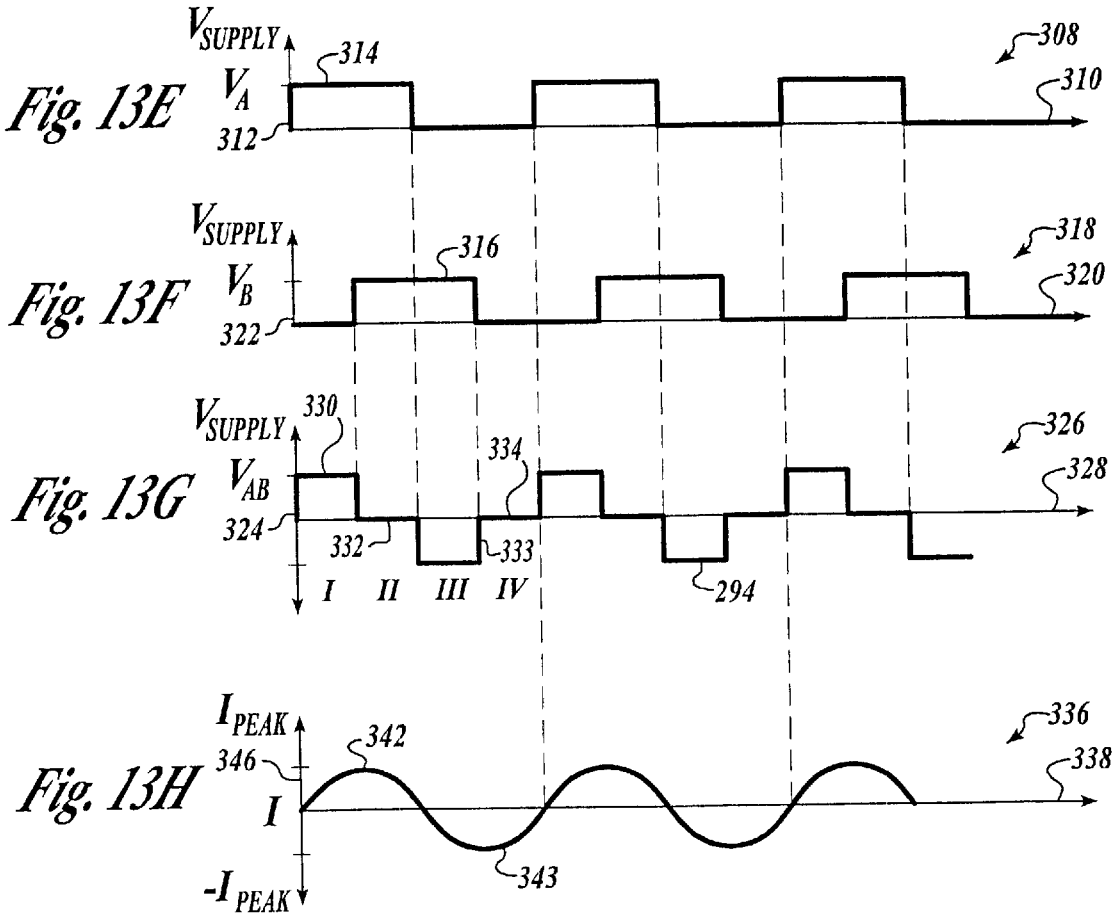

In FIG. 13A, four graphs illustrate pulse train phase modulation of the AC voltage signal and the current supplied to the load under maximum power conditions. In a top row graph 278, a horizontal time axis 272 and a vertical voltage axis 274 are shown. A positive voltage square-shaped waveform 276 is equal to the voltage provided by the voltage supply. Also, the waveform is on for the first half of the power cycle and off for the second half of the cycle.

In a second row graph 286, a horizontal time axis 284 and a vertical voltage axis 280 are shown. A positive voltage square-shaped waveform 282 is equal to the voltage provided by the voltage supply. Also, the waveform is off for the first half of the power cycle and on for the second half of the cycle.

In a third row graph 288, a horizontal time axis 296 and a vertical voltage axis 290 are shown. A positive voltage square-shaped waveform 292 is equal to the voltage provided by the voltage supply and a negative voltage square-shaped waveform 294 is equal to the voltage provided by the supply. Also, the voltage waveforms alternate being on during the power cycle, i.e., the positive waveform is on for the first half of the cycle and the negative waveform is on for the second half.

In a fourth row graph 300, a horizontal time axis 302 and a vertical current axis 306 are displayed that correspond to the voltage waveform illustrated in the graph 288. The maximum value of the positive current waveform 304 is equal to a positive peak current value. Similarly, the maximum value of the negative current waveform 303 is equal to a negative peak current value.

In FIG. 13B, four graphs illustrate pulse train phase modulation of the AC voltage signal and the current supplied to the load under reduced power conditions. In a top row graph 308, a horizontal time axis 310 and a vertical voltage axis 312 are shown. A positive voltage square-shaped waveform 314 is equal to the voltage provided by the voltage supply. Also, the positive waveform 314 has a 50 percent duty cycle, i.e., the waveform is on for the first and second quarters (first half) of the power cycle and off for the third and fourth quarters (second half) of the cycle.

In a second row graph 318, a horizontal time axis 320 and a vertical voltage axis 322 are shown. A positive voltage square-shaped waveform 316 is equal to the voltage provided by the voltage supply. Also, the positive voltage waveform has a 50 percent duty cycle, i.e., the waveform is on for the second and third quarters of the power cycle and off for the first and fourth quarters of the cycle.

In a third row graph 326, a horizontal time axis 328 and a vertical voltage axis 324 are shown. A positive voltage square-shaped waveform 330 is equal to the voltage provided by the voltage supply and a negative voltage square-shaped waveform 333 is equal to the voltage provided by the supply. The positive voltage waveform 330 is only on for the first quarter of the power cycle and the negative waveform 333 is only on for the third quarter of the cycle. During the second and fourth quarters of the power cycle, the net voltage across the load is zero because the voltage at the two outputs of the H bridge are equal and therefore cancel each other out.

In a fourth row graph 336, a horizontal time axis 338 and a vertical current axis 340 are displayed that correspond to the voltage waveform illustrated in the graph 326. The maximum value of the positive current waveform 342 is equal to a positive peak current value. Similarly, the maximum value of the negative current waveform 343 is equal to a negative peak current value. Also, the current waveform is shown delivering a reduced amount of power to the load. Additionally, it is envisioned that the relative phase of the voltage waveforms shown in graphs 308 and 318 could be varied to further modulate the amount of power delivered to the load.

Figure 14:
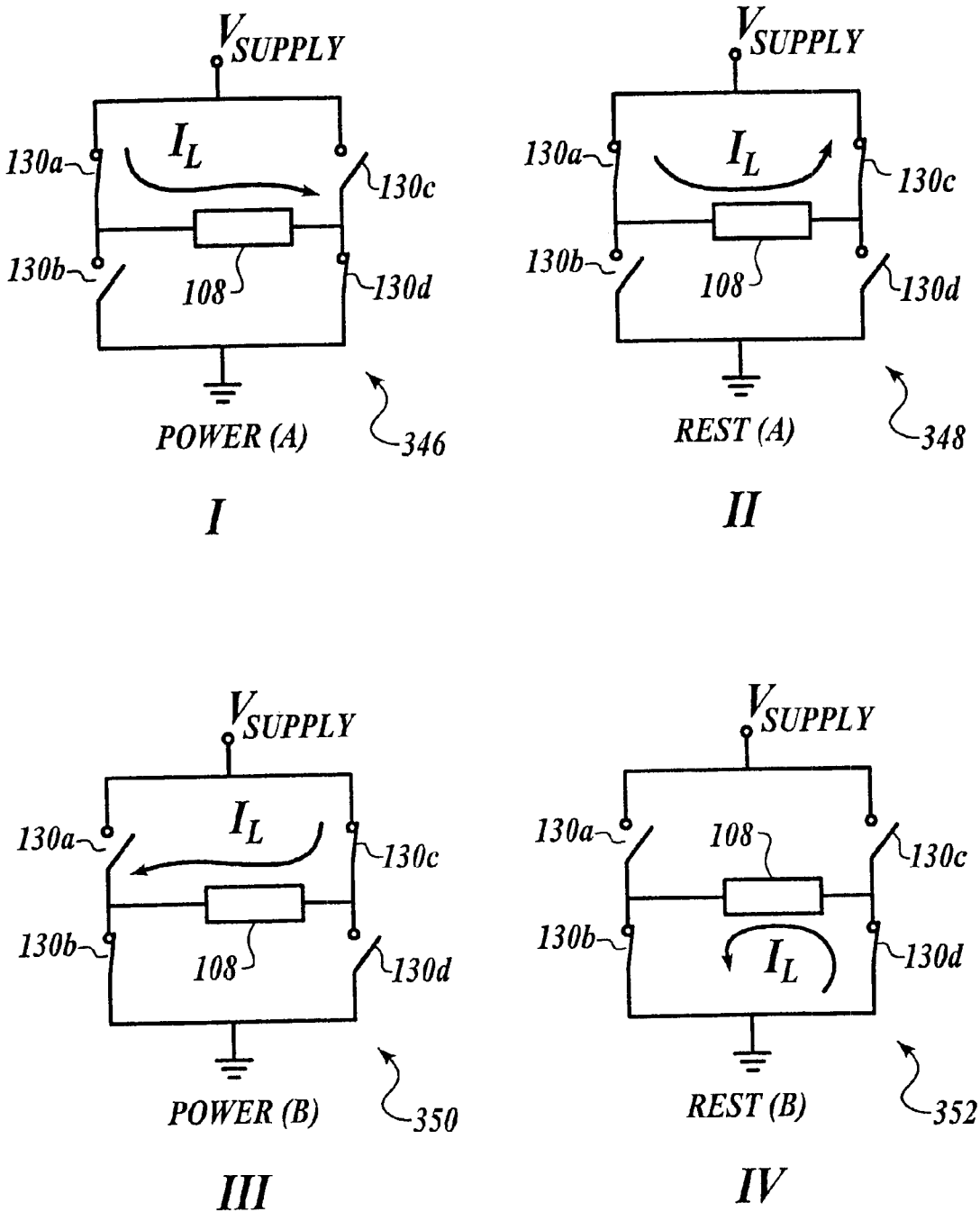
FIG. 14 shows the four states of the power switches and the direction of the load current during phase modulation.

Looking now to FIG. 14, a schematic overview 344 shows the present invention configured in four operational modes that complete a cycle for driving a load with a phase modulated AC signal. All four phases, i.e., a power phase "I" 346, a rest phase "II" 348, a power phase "III" 350, and a rest phase "IV" 352, employ the same components. The power MOSFETs 130*a*, 130*b*, 130*c* and 130*d* are illustrated as discrete switches. When a power MOSFET is on (conducting), it is represented as a closed switch. Also, when the power MOSFET is off (non-conducting), it is represented as an open switch. In this way, the state of conduction for the power MOSFETs may be more clearly illustrated for the different phases of the cycle. The physical configuration of the MOSFETs is substantially similar to the configuration as presented in the discussion of FIG. 10 above.

As illustrated in power phase "I" 346, diagonally opposite power transistors 130*b* and 130*c* are off (open position) and power transistors 130*a* and 130*d* are on (closed position). A current from the Vsupply terminal flows through the power transistor 130*a*, passes through the tank circuit 108 and returns to earth ground through power transistor 130*d*.

When the flow of current from the Vsupply terminal is at least equal to a predetermined peak value as indicated by the peak current comparator 138 or the on-time timer 142 has finished, the power transistors will switch from power phase "I" 346 to the configuration identified as rest phase "II" 348. However, if neither of these conditions has occurred and the tank current has returned to the zero crossing point as indicated by the zero crossing detector 140, the power transistors will bypass the rest phase "A" and switch directly to the configuration identified as a power phase "III" 350. Typically, the bypassing of a rest phase will occur when there is a high load and a relatively low Vsupply voltage.

Rest phase "II" 348 is shown with the top laterally opposite power transistors 130*a* and 130*c* disposed in the closed position (on) and the bottom laterally opposite power transistors 130*b* and 130*d* configured in the open position (off). In the rest phase "II" 348 configuration, the tank circuit 108 discharges stored energy into the load by circulating a current through power transistors 130*a* and 130*c*. After the tank circuit has discharged at least a portion of its stored energy, the power transistors switch to the configuration identified as the power phase "III" 350.

Similarly, the power phase "III" 350 illustrates diagonally opposite power transistors 130*a* and 130*d* disposed in an open position and power transistors 130*b* and 130*c* in a closed position. A current from the Vsupply terminal flows through the power transistor 130*c*, passes through the tank circuit 108 and returns to ground through power transistor 130*b*. When the flow of current from the Vsupply terminal is at least equal to a predetermined peak current value indicated by the peak current comparator 138 or the on-time timer 142 has timed out, the power transistors switch from the power phase "III" 350 to the configuration identified as the rest phase "IV" 352.

Rest phase "IV" 352 is shown with top laterally opposite power transistors 130*a* and 130*c* disposed in the open position and the power transistors 130*b* and 130*d* configured in the closed position. In the rest phase "B" 208, the tank circuit 108 will discharge stored energy, i.e., a current, through power transistor 130*b* to ground. After discharging the stored energy for a period of time, the power transistors will return to the power phase "I" 346 configuration and the cycle of phases will repeat. In this way, power is transferred to the load continuously throughout the cycle (both power and rest phases) and the stored energy in the tank circuit 108 is replenished during each power phase.

In burst mode dimming, the discharge lamp 106 is switched on and off at an invisibly fast rate such as 180 Hertz. When the discharge lamp 106 is on, the frequency of the AC signal driving the lamp is determined by the on-time timer 142 and the zero crossing detector 140. A typical operating frequency would be 50 kilohertz. For a 50% burst mode dimming, the discharge lamp 106 would be turned off half of the time. In practice for the representative frequencies chosen this would mean that an on time would last 2.7 milliseconds and would comprise 135 cycles of 50 khz oscillation. This on time would be followed by 2.7 milliseconds of off time. Similarly, a 5% burst mode dimming would have an on time of 0.27 milliseconds comprising about 13 cycles of 50 Khz lamp current followed by approximately 5.3 milliseconds of off time. The sum of the on and off periods would equal 180 hertz. When burst mode dimming is asserted (the discharge lamp is off), analog feedback in the IC 104 is considered invalid. In this way, the loop compensation capacitor 148 is neither charged nor discharged and the correct on-time setting for the on-time timer 142 is "remembered" between burst mode off states.

Figures 15A, 15B, 15C, 15D, 15E, 15F, 15G, 15H, 15I:
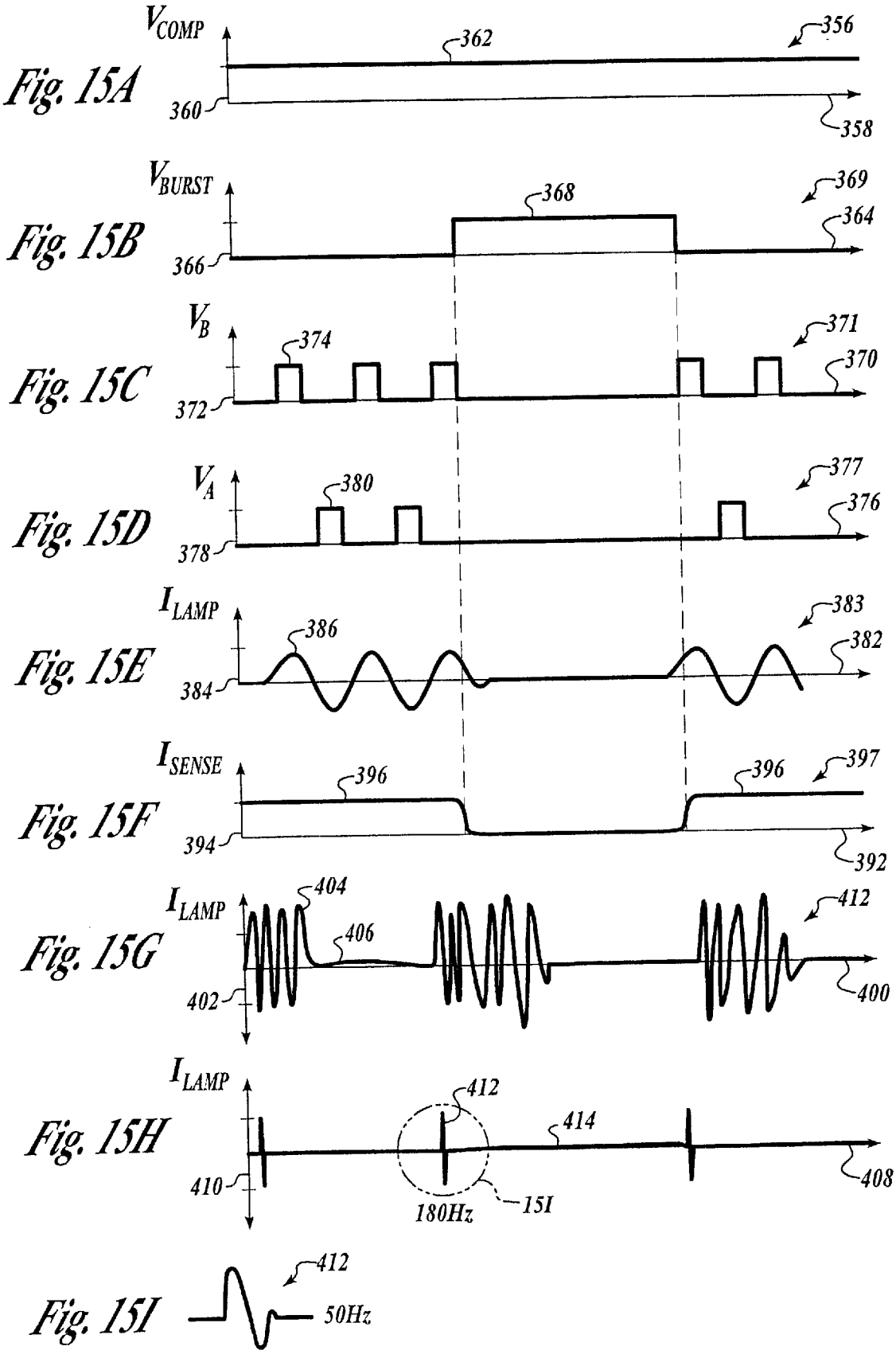
FIGS. 15A-F illustrate six graphs for burst mode modulation of the voltage waveform and the current waveform at partial power.
FIGS. 15G–15L illustrate two graphs for burst mode modulation of the lamp current waveform at 50% and 1% dimming.
Figure 15J:
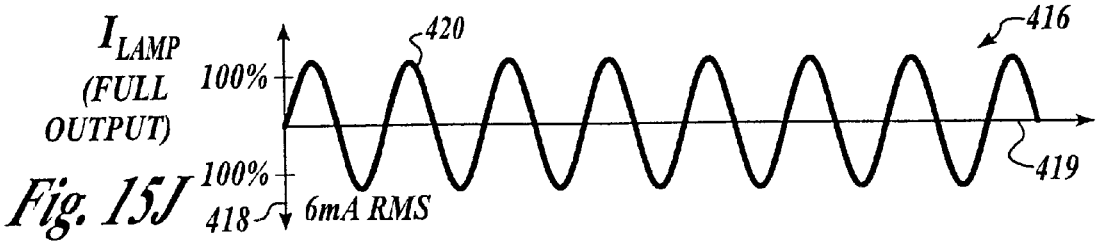
Figure 15K:
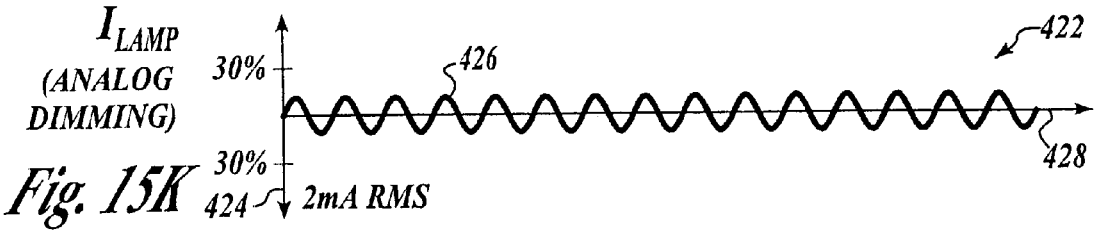
Figure 15L:
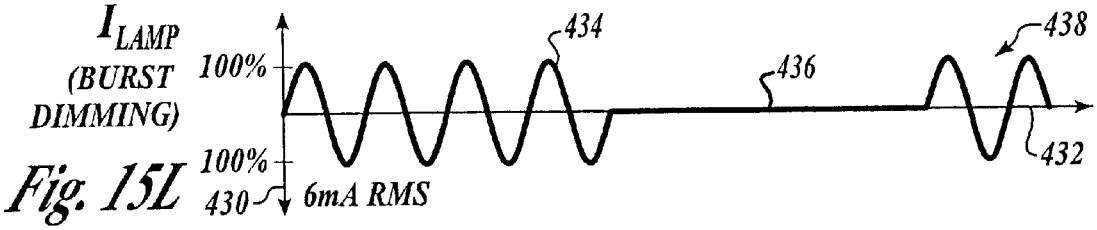
Figure 15M:
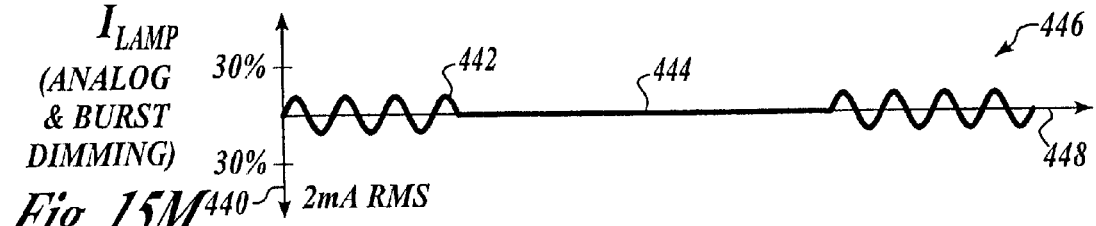
FIG. 15M displays four graphs for burst mode modulation of the lamp current waveform with analog and burst mode dimming.

FIGS. 15A–15C graphically illustrate the current and voltage waveforms associated with burst mode dimming. In FIG. 15A, six graphs illustrate burst mode dimming employed with the AC voltage and current waveforms driving the discharge lamp 106. In a graph 356, a vertical voltage (Vcomp) axis 360 and a horizontal time axis 358 are displayed that correspond to the voltage waveform on the loop compensation capacitor 148. Graph 369 illustrates a vertical voltage (Vburst) axis 366 and a horizontal time axis 364 that correspond to a square-shaped burst mode signal 368. In a graph 371, a vertical voltage (Vb) axis 372 and a horizontal time axis 370 are shown that correspond to a series of square-shaped voltage waveforms 374. The voltage waveform 374 is not generated for the time interval when the burst mode signal 368 is asserted. Another graph 377 displays a vertical voltage (Va) axis 378 and a horizontal time axis 376 that correspond to a series of square-shaped voltage waveforms 380. The voltage waveform 380 is not generated for the time interval when the burst mode signal 368 is asserted. A graph 383 illustrates a vertical current (Ilamp) axis 384 and a horizontal time axis 382 that correspond to a sinusoidal current waveform 386 for driving a discharge lamp. When the burst mode signal 368 is asserted (on), the current waveform 386 quickly decays to a zero value. Also, when the burst mode signal 368 is off, the current waveform 386 is generated at the same frequency and amplitude prior to the assertion of the burst mode signal. In a graph 397, a vertical current (Isense) axis 394 and a horizontal time axis 392 are displayed that correspond to a relatively linear current waveform 396 associated with the amount of sensed current flowing to the discharge lamp 106. The initial value of the current waveform 396 decays to zero when the burst mode signal is asserted (on) and returns to the initial value when the burst mode signal is unasserted (off). Even though the Isense current waveform 396 transitions to a zero value when the burst mode signal is asserted, the Vcomp voltage waveform 362 is not affected. In this way, the circuitry producing the AC signal driving the discharge lamp can generate the same signal prior to the assertion of the burst mode signal 368.

FIG. 15B illustrates two graphs that show different duty cycles (on times) for burst mode dimming of the discharge lamp 106. In a graph 412, a vertical current axis 402 and a horizontal time axis 400 are displayed that correspond to a 50% duty cycle for a sinusoidal current waveform 404 that drives the discharge lamp 106. A linear-shaped current waveform 406 with an almost zero value is shown during the periodic time intervals when a burst mode signal (not shown) is asserted (on). Graph 414 displays a vertical current axis 410 and a horizontal time axis 408 that correspond to a 1% duty cycle for a sinusoidal current waveform 412 that drives the discharge lamp 106. A linear-shaped current waveform 414 with an almost zero value is shown during the periodic time intervals when a burst mode signal (not shown) is being asserted (on). In this case, the on time for the 1% duty cycle current waveform 412 has a 180 Hertz frequency.

FIG. 15C shows four graphs that illustrate burst mode dimming and analog dimming for a current waveform driving the discharge lamp 106. In a graph 416, a vertical current (Ilamp) axis 418 and a horizontal time axis 419 correspond to a sinusoidal current waveform 420 providing full power (6 milliamps RMS) to the discharge lamp 106. Graph 422 displays a vertical current (Ilamp) axis 424 and a horizontal time axis 428 that corresponds to a sinusoidal current waveform 426 that causes analog dimming of the discharge lamp 106 by continuously providing only one third of the full power (2 milliamps RMS) to the lamp. Analog dimming may be accomplished with a potentiometer (not shown) for varying the amplitude of the AC signal driving the discharge lamp 106. In a graph 438, a vertical current (Ilamp) axis 430 and a horizontal time axis 432 are illustrated that correspond to a current waveform 434 for driving the discharge lamp 106. A linear-shaped current waveform 436 with an almost zero value is shown during a time interval when the burst mode signal (not shown) is asserted (on). In this case, the full power (6 milliamps RMS) current waveform 434 only drives the discharge lamp at periodic intervals (30% on-time) which causes the discharge lamp to be dimmed by the absence of the current waveform. A linear-shaped current waveform 444 with an almost zero value is shown when the burst mode signal (not shown) is asserted (on). Graph 446 displays a combination of analog and burst mode dimming with a vertical current (Ilamp) axis 440 and a horizontal time axis 448 that correspond to a sinusoidal current waveform 442. The current waveform 442 provides analog dimming because it delivers only one third (2 milliamps RMS) of the full power current waveform 420 (6 milliamps RMS). Additionally the current waveform only drives the discharge lamp 106 at periodic intervals (30% on-time) which further causes the discharge lamp to be dimmed by the absence of the one third power current waveform 442.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL, wherein the filtering means includes a step up transformer having a primary winding that receives the AC signal from the network of the plurality of switches and having a secondary winding that is coupled to the CCFL, a ratio of the primary winding and the secondary winding causing the AC signal to be induced across the secondary winding with a voltage that has a value different than another value of another voltage of the AC signal received by the primary winding; and (c) a controller for periodically opening and closing portions of the network of the plurality of switches generally at a resonant frequency of the filtering means, so that electrical power is provided for driving the CCFL under a range of voltages provided by the DC signal, wherein the filtering means includes a filter for the AC signal.

2. The apparatus of Claim 1, wherein the filter is disposed between the network of the plurality of switches and a primary winding of the step-up transformer.

3. The apparatus of claim 1, wherein the filter is disposed between a secondary winding of the step-up transformer and the CCFL.

4. The apparatus of claim 1, wherein the filter is a second order filter that includes an inductance component and a capacitance component.

5. The apparatus of claim 4, wherein the transformer provides the inductance component.

6. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the filtering meanssuppresses a harmonic signal associated with the AC signal.

7. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the filtering means smoothes a waveform of the AC signal.

8. The apparatus of claim 7, wherein the zero crossing detector tracks the frequency response of the filtering means when the AC signal is driving the CCFL, the zero crossing detector providing an indication to the controller when the resonant frequency has moved from one value to another value.

9. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the DC signal includes a range of selectable voltages.

10. The apparatus of claim 9, further comprising a control for dimming the amount of light emitted by the CCFL, the selection of the control causing the AC signal driving the CCFL to be varied in relation to a change in a voltage across a capacitor.

11. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller implements logical instructions, comprising:

(a) determining an undervoltage condition at the CCFL; and if true (b) causing the AC signal to not drive the CCFL.

12. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller implements logical instructions, comprising:

(a) determining if a thermal overload condition is occurring; and if so (b) causing the AC signal to not drive the CCFL.

13. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller implements logical instructions, comprising:

(a) determining if a current to the CCFL has exceeded a predetermined maximum current; and if true (b) causing the AC signal to not drive the CCFL.

14. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the periodic opening and closing of portions of the network of the plurality of switches generally at a resonant frequency of the filtering means, further comprising a power phase for the portion of the network of the plurality switches and another power phase for the other portion of the network of the plurality of switches, so that each power phase generates an opposite waveform of the AC signal used to drive the CCFL.

15. The apparatus of claim 14, further comprising a rest phase after the power phase and another rest phase after the other power phase, the rest phase and the other rest phase enabling the controller to reduce the amount of electrical power driving the CCFL.

16. The apparatus of claim 14, wherein the opposite waveforms for each power phase have a symmetrical shape so that the formation of a harmonic signal in the AC signal is suppressed.

17. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller periodically opens and closes portions of the network of the plurality of switches based on a trailing edge of a current waveform of the AC signal, so that a reduced amount of power is delivered to the CCFL.

18. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller periodically opens and closes portions of the network of the plurality of switches based on a leading edge of a current waveform of the AC signal, so that a reduced amount of power is delivered to the CCFL.

19. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller periodically opens and closes portions of the network of the plurality of switches based on a duty cycle to phase modulate the AC signal.

20. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the duty cycle is varied so that the AC signal delivers a reduced amount of power to the CCFL.

21. An apparatus for converting a direct current (DC) signal into an alternating current (AC) signal for driving a cold cathode fluorescent lamp (CCFL), comprising:

(a) a H-bridge network of a plurality of switches for generating an AC signal from a DC signal coupled to the network of the plurality of switches, the AC signal being generated by a first portion of the network of the plurality of switches periodically opening and closing opposite to the periodic opening and closing of a second portion of the network of the plurality of switches, said first portion of the network being diagonally opposed to said second portion of the network;

(b) filtering means being coupled between the network of the plurality of switches and the CCFL, the filtering means filtering the AC signal delivered to the CCFL; and (c) a controller for periodically opening and closing portions of the network of the plurality of switches generally at a resonant frequency of the filtering means, so that electrical power is provided for driving the CCFL under a range of voltages provided by the DC signal, wherein the controller periodically opens and closes portions of the network of the plurality of switches based on a double sided phase modulation of the AC signal.

22. A controller for directing a H-bridge network of a plurality of switches to generate an AC signal from a DC signal coupled to the network of the plurality of switches, the AC signal for driving a cold cathode fluorescent lamp (CCFL), the AC signal being generated by a first portion of the network of the plurality of switches periodically opening and closing opposite to the periodic opening and closing of a second portion of the network of the plurality of switches, said first portion of the network being diagonally opposed to said second portion of the network, said H-bridge having a filtering means coupled between the network of the plurality of switches and the CCFL, said filtering means filtering the AC signal delivered to the CCFL, said controller operative to periodically open and close close portions of the network of the plurality of switches generally at a resonant frequency of the filtering means, so that electrical power is provided for driving the CCFL under a range of voltages provided by the DC signal, further comprising a control for dimming the amount of light emitted by the CCFL, the selection of the control causing the AC signal driving the CCFL to be varied in relation to a change in a voltage across a capacitor.

23. A controller for directing a H-bridge network of a plurality of switches to generate an AC signal from a DC signal coupled to the network of the plurality of switches, the AC signal for driving a cold cathode fluorescent lamp (CCFL), the AC signal being generated by a first portion of the network of the plurality of switches periodically opening and closing opposite to the periodic opening and closing of a second portion of the network of the plurality of switches, said first portion of the network being diagonally opposed to said second portion of the network, said H-bridge having a filtering means coupled between the network of the plurality of switches and the CCFL, said filtering means filtering the AC signal delivered to the CCFL, said controller operative to periodically open and close close portions of the network of the plurality of switches generally at a resonant frequency of the filtering means, so that electrical power is provided for driving the CCFL under a range of voltages provided by the DC signal, wherein the controller implements logical instructions, comprising:

(a) determining an undervoltage condition at the CCFL; and if true (b) causing the AC signal to not drive the CCFL.

24. A controller for directing a H-bridge network of a plurality of switches to generate an AC signal from a DC signal coupled to the network of the plurality of switches, the AC signal for driving a cold cathode fluorescent lamp (CCFL), the AC signal being generated by a first portion of the network of the plurality of switches periodically opening and closing opposite to the periodic opening and closing of a second portion of the network of the plurality of switches, said first portion of the network being diagonally opposed to said second portion of the network, said H-bridge having a filtering means coupled between the network of the plurality of switches and the CCFL, said filtering means filtering the AC signal delivered to the CCFL, said controller operative to periodically open and close close portions of the network of the plurality of switches generally at a resonant frequency of the filtering means, so that electrical power is provided for driving the CCFL under a range of voltages provided by the DC signal, wherein the controller implements logical instructions, comprising:

(a) determining if a thermal overload condition is occurring; and if so (b) causing the AC signal to not drive the CCFL.

25. A controller for directing a H-bridge network of a plurality of switches to generate an AC signal from a DC signal coupled to the network of the plurality of switches, the AC signal for driving a cold cathode fluorescent lamp (CCFL), the AC signal being generated by a first portion of the network of the plurality of switches periodically opening and closing opposite to the periodic opening and closing of a second portion of the network of the plurality of switches, said first portion of the network being diagonally opposed to said second portion of the network, said H-bridge having a filtering means coupled between the network of the plurality of switches and the CCFL, said filtering means filtering the AC signal delivered to the CCFL, said controller operative to periodically open and close close portions of the network of the plurality of switches generally at a resonant frequency of the filtering means, so that electrical power is provided for driving the CCFL under a range of voltages provided by the DC signal, wherein the controller implements logical instructions, comprising:

(a) determining if a current to the CCFL has exceeded a predetermined maximum current; and if true (b) causing the AC signal to not drive the CCFL.

26. A controller for directing a H-bridge network of a plurality of switches to generate an AC signal from a DC signal coupled to the network of the plurality of switches, the AC signal for driving a cold cathode fluorescent lamp (CCFL), the AC signal being generated by a first portion of the network of the plurality of switches periodically opening and closing opposite to the periodic opening and closing of a second portion of the network of the plurality of switches, said first portion of the network being diagonally opposed to said second portion of the network, said H-bridge having a filtering means coupled between the network of the plurality of switches and the CCFL, said filtering means filtering the AC signal delivered to the CCFL, said controller operative to periodically open and close close portions of the network of the plurality of switches generally at a resonant frequency of the filtering means, so that electrical power is provided for driving the CCFL under a range of voltages provided by the DC signal, wherein said plurality of switches of said H-bridge are MOSFETs and further comprising a gate driver for each MOSFET in the H-bridge network, each gate driver providing amplification of logic signals that control the operation of the associated MOSFET.

27. The apparatus of claim 26, wherein the gate driver provides for a lockout mode that prevents the associated MOSFET from cross conducting with another MOSFET.

28. A controller for directing a H-bridge network of a plurality of switches to generate an AC signal from a DC signal coupled to the network of the plurality of switches, the AC signal for driving a cold cathode fluorescent lamp (CCFL), the AC signal being generated by a first portion of the network of the plurality of switches periodically opening and closing opposite to the periodic opening and closing of a second portion of the network of the plurality of switches, said first portion of the network being diagonally opposed to said second portion of the network, said H-bridge having a filtering means coupled between the network of the plurality of switches and the CCFL, said filtering means filtering the AC signal delivered to the CCFL, said controller operative to periodically open and close close portions of the network of the plurality of switches generally at a resonant frequency of the filtering means, so that electrical power is provided for driving the CCFL under a range of voltages provided by the DC signal, wherein the periodic opening and closing of portions of the network of the plurality of switches generally at a resonant frequency of the filtering means, further comprising a power phase for the portion of the network of the plurality switches and another power phase for the other portion of the network of the plurality of switches, so that each power phase generates an opposite waveform of the AC signal used to drive the CCFL.

29. The apparatus of claim 28, further comprising a rest phase after the power phase and another rest phase after the other power phase, the rest phase and the other rest phase enabling the controller reduce the amount of electrical power driving the CCFL.

30. The apparatus of claim 28, wherein the opposite waveforms for each power phase have a symmetrical shape so that the formation of a harmonic signal in the AC signal is suppressed.

* * * * *

UNITED STATES PATENT AND TRADEMARK OFFICE

CERTIFICATE OF CORRECTION

PATENT NO. : 6,633,138 B2
DATED : October 14, 2003
INVENTOR(S) : John Robert Shannon et al.

It is certified that error appears in the above-identified patent and that said Letters Patent is hereby corrected as shown below:

Column 11,
Line 4, “terminals” should be -- terminal --;

Signed and Sealed this

Thirteenth Day of January, 2004

JON W. DUDAS
*Acting Director of the United States Patent and Trademark Office*